US006655229B2

(12) United States Patent
Yamamoto et al.

(10) Patent No.: US 6,655,229 B2
(45) Date of Patent: Dec. 2, 2003

(54) OPERATION LEVER DEVICE

(75) Inventors: Yuuichi Yamamoto, Oyama (JP); Yasuhiro Satou, Oyama (JP); Shuuji Hori, Oyama (JP); Naoki Ishizaki, Tochigi (JP)

(73) Assignee: Komatsu Ltd., Tokyo (JP)

( * ) Notice: Subject to any disclaimer, the term of this patent is extended or adjusted under 35 U.S.C. 154(b) by 90 days.

(21) Appl. No.: 09/754,215

(22) Filed: Jan. 5, 2001

(65) Prior Publication Data

US 2002/0059845 A1 May 23, 2002

(30) Foreign Application Priority Data

Jan. 11, 2000 (JP) ..... 2000-002856
Nov. 22, 2000 (JP) ..... 2000-356490

(51) Int. Cl.[7] ..... F15B 11/08; G05G 9/00; G05G 13/00; G05G 9/047; E02F 9/20

(52) U.S. Cl. ..... 74/471 XY; 91/522; 137/636.2; 267/150; 74/491; 74/471 R; 180/333; 180/6.2

(58) Field of Search ..... 74/471 XY, 471 R, 74/491, 469, 479.01, 529, 484 R, 536, 473.33, 473.34, 473.35; 414/726, 685, 694; 137/636, 636.2, 636.4, 636.3; 267/150; 180/333, 315, 332, 6.2; 244/234; 172/812, 818, 819–823, 824–828; 91/521, 530, 531, 522; 212/289; 251/231, 235; 37/192, 701, 244, 477

(56) References Cited

U.S. PATENT DOCUMENTS 1,030,229 A * 6/1912 Cheney
3,131,574 A * 5/1964 Clingerman
3,266,523 A * 8/1966 Stevens
3,815,436 A * 6/1974 Morimoto et al.
3,891,042 A * 6/1975 Braun ..... 74/471 XY
3,918,496 A * 11/1975 Byers, Jr. ..... 74/471 XY
4,187,737 A * 2/1980 Mori et al. ..... 74/471 XY
4,350,055 A * 9/1982 Pinomaki ..... 74/471 XY
4,569,244 A * 2/1986 Akerstrom ..... 74/471 XY
4,920,820 A * 5/1990 Ingham et al. ..... 74/491
4,938,091 A * 7/1990 Waggoner et al. ..... 74/471 XY
4,962,448 A * 10/1990 DeMaio et al. ..... 74/471 XY
4,978,273 A * 12/1990 Radke et al. ..... 74/471 XY
5,127,284 A * 7/1992 Jorgensen ..... 74/471 XY
5,160,918 A * 11/1992 Saposnik et al. ..... 74/471 XY
5,232,057 A * 8/1993 Renard
5,277,258 A * 1/1994 O'Dell
5,285,861 A * 2/1994 Nakamura
5,288,198 A * 2/1994 Mozingo ..... 414/685

(List continued on next page.)

FOREIGN PATENT DOCUMENTS

JP 7190012 * 7/1995
JP 124010 A * 5/2001
JP 125657 A * 5/2001
JP 262625 A * 9/2001

*Primary Examiner*—Douglas C. Butler
(74) *Attorney, Agent, or Firm*—Varndell & Varndell, PLLC

(57) ABSTRACT

It is designed that an oil pressure signal can be output by operating an operation lever in a twisting direction; a structure can be made simple and its assembly and adjustment are easy; an operation force can be reduced; and a layout is not restricted. It is also designed that when the operation lever is left free after it is twisted, it returns smoothly to the original neutral position. When the operation lever is twisted about the lever axis, the shaft supported by bearings is twisted. The twist of the shaft is converted into the movement in a direction to move the pistons by first and second levers, and the pistons are moved. When the pistons are moved, the oil pressure signal is output from the discharge ports. A disk plate is separated into a first disk plate to which the root of the operation lever is attached and a second disk plate which is tiltably supported by a tilting fulcrum. And, the first disk plate is independent of the second disk plate and twisted about the lever axis of the operation lever.

8 Claims, 22 Drawing Sheets

U.S. PATENT DOCUMENTS 5,316,435 A * 5/1994 Mozingo ..... 414/685
5,349,881 A * 9/1994 Olorenshaw
5,429,037 A * 7/1995 Weber et al. ..... 91/522
5,480,276 A * 1/1996 Mozingo ..... 74/471 XY
5,513,552 A * 5/1996 Ardelt ..... 91/522
5,592,856 A * 1/1997 Parsons ..... 267/150
5,692,541 A * 12/1997 Brown ..... 137/636.2
5,868,230 A * 2/1999 Chatterjea et al. ..... 137/636.3
5,985,401 A * 11/1999 Yamamoto ..... 74/471 R
6,019,133 A * 2/2000 Riedel et al. ..... 414/685
6,029,537 A * 2/2000 Nagao ..... 74/471 XY
6,213,244 B1 * 4/2001 Waggoner et al. ..... 180/333
6,227,066 B1 * 5/2001 Stachniak ..... 74/471 XY
6,328,127 B1 * 12/2001 Hori et al. ..... 180/333
6,460,639 B1 * 10/2002 Hori et al. ..... 180/333

* cited by examiner

OPERATION LEVER DEVICE

BACKGROUND OF THE INVENTION

1. Field of the Invention

The present invention relates to an operation lever device, and more particularly to an operation lever device which can output an oil pressure signal by twisting an operation lever.

2. Description of the Related Art

The bulldozer is provided with a blade. The blade is operated to perform "blade up, down, and float", "right tilt and left tilt", and "right angle and left angle". To make such operations, the bulldozer is provided with hydraulic cylinders and flow rate control valves for respective operations. Specifically, the bulldozer is provided with a blade up-and-down flow-rate control valve, a tilting flow-rate control valve and an angle control valve. Those three flow rate control valves are driven by operating the hydraulic operation lever. More specifically, when the hydraulic operation lever is operated, a pilot pressure corresponding to an operated amount is applied to respective pilot ports of the flow rate control valves. And, a pressure oil with a flow rate corresponding to the pilot pressure applied to each pilot port is supplied to the each hydraulic cylinder. Thus, the blade is operated.

When it is necessary to operate three flow rate control valves, namely operation objects for three axes by at least two operation levers, the operations are troublesome, placing a burden on the operator.

Therefore, an operation lever device which can operate the operation objects for three axes by a single operation lever has been proposed heretofore.

Japanese Patent Publication No. 3-44326 describes an invention of an electric operation lever device which can operate the operation objects for three axes by freely operating an electric operation lever in three directions of back and forth, right and left, and twisting.

But, the electric operation lever needs a sensor such as a potentiometer in order to detect an operated amount. And, a controller and an electromagnetic proportion valve are also needed to convert an electric signal output from the electric operation lever into an oil pressure signal. Accordingly, it has disadvantages that the number of components is increased and the structure becomes complex.

Japanese Patent Application Laid-Open Publication No. 7-117705 also describes an invention of an operation lever device which can operate operation objects for three axes by freely operating an operation lever in three directions of back and forth, right and left, and twisting.

Such an operation lever device has a structure having the operation lever connected to a spool of the flow rate control valves by a link mechanism. Operation of the operation lever directly pushes or pulls the spool of the flow rate control valve through the link mechanism.

But, the above link structure for the three axes is complex. It has disadvantages that its components require high accuracy, and the assembly and adjustment of the operation lever device require a great deal of time. It also has drawbacks that the force to operate the operation lever has to be high and the operator becomes tired easily because the spool of the flow rate control valve is directly pushed or pulled through the link mechanism. Besides, the operation lever and the flow rate control lever are mutually disposed uniquely and must be accurate because the operation lever is connected to the spool of the flow rate control valve through the link mechanism. Thus, there is another disadvantage that the layout of the respective equipment is restricted.

Meanwhile, an invention related to a biaxial hydraulic operation lever device which can output an oil pressure signal when the operation lever is operated in a back and forth direction and a right and left direction is known well. But, an invention directed to a hydraulic operation lever device which can output an oil pressure signal by operating the operation lever in a twisting direction has not be achieved yet.

It is a first object of a first aspect of the present invention to make it possible to output an oil pressure signal by operating the operation lever in the twisting direction, to make a structure simple, to facilitate its assembly and adjustment, to lower its operation force, and to eliminate the restriction of its layout.

The operation lever device used for construction machines such as a bulldozer is sometimes provided with a mechanism for keeping the operation lever in a tilted state. The mechanism for keeping the operation lever in the tilted state is called a detent mechanism.

But, it was found that the disposition of the detent mechanism for the operation lever device which operates the operation lever in three directions of back and forth, right and left, and twisting has the following drawbacks.

Specifically, when shaft section 8*c* of the operation lever of FIG. 2 is tilted, the bottom surface of disk plate 9 comes into contact with top end (stopper) 12*a* of plate 12. At the time, when the detent mechanism is operating, the shaft section 8*c* of the operation lever is fixed in a tilted position.

When the shaft section 8*c* of the operation lever in the aforesaid state is twisted, frictional force is produced between the bottom surface of the disk plate 9 and the top end 12*a* of the plate 12. Therefore, even if the hand is moved off the operation lever after the shaft section 8*c* of the operation lever is twisted, the shaft section 8*c* of the operation lever does not return smoothly to the original neutral position because of the frictional force.

It is a second object of a second aspect of the invention to enable the operation lever return to the original neutral position smoothly when the hand is moved off the operation lever after it is twisted.

OBJECTS AND SUMMARY OF THE INVENTION

Therefore, in order to achieve the first object, the first aspect of the invention is an operation lever device which moves pistons (5, 6) according to an operation of operation lever (8), outputs an oil pressure signal according to the movement of the pistons (5, 6) and operates operation object (33) according to the oil pressure signal, and is comprised of twisting means (13, 14, 15) for twisting the operation lever (8) about lever axis (8*a*), and conversion means (18, 19) for converting the motion to twist the operation lever (8) about the lever axis (8*a*) into motion to move the pistons (5, 6).

The first aspect of the invention will be described specifically with reference to FIG. 2.

According to the first aspect of the invention, when the operation lever 8 is twisted about the lever axis 8*a*, the shaft 13 supported by the bearings 14, 15 is twisted. The twist of the shaft 13 is converted into the movement in a direction that the piston 5 is moved by the first lever 18 and the second lever 19, and the piston 5 is moved. When the piston 5 is moved, the oil pressure signal is output from discharge port 25.

According to the first aspect of the invention, the operation lever device 10 may be provided with a mechanism for twisting the operation lever 8 and a mechanism for converting the twist into motion to move the piston 5. Therefore, it is different from a conventional electric operation lever device and has a simple structure without requiring a sensor, a controller and the like.

Besides, it is not a structure to directly push or pull the spool of the flow rate control valve by a link mechanism but follows a structure to output the oil pressure signal according to the movement of the pistons in the same way as the conventional hydraulic operation lever device. Therefore, the operation lever device can be assembled and adjusted easily without necessitating lots of time. Because the pistons are moved by operating the operation lever in the same way as the conventional hydraulic operation lever device, the operation lever is operated by the same small force as before, and an operator does not get tired. Besides, it is not a structure having the operation lever and the spool of the flow rate control valve connected by a link mechanism but a structure following the structure which outputs the oil pressure signal according to the movement of the pistons in the same way as the conventional hydraulic operation lever device. Therefore, it is not necessary to closely dispose the operation lever and the flow rate control valve and does not restrict the layout of respective equipment.

As described above, the oil pressure signal can be output by operating the operation lever in the twisting direction according to the first aspect of the invention, so that there are effects that the structure is simple, its assembly and adjustment are easy, the operation force can be reduced, and the respective equipment can be laid out freely.

A second aspect of the invention is an operation lever device which moves pistons (1, 2, 3, 4) according to a tilted direction and a tilted amount of operation lever (8), outputs an oil pressure signal according to the movement of the pistons (1, 2, 3, 4) and operates operation objects corresponding to first and second shafts (31, 32) according to the oil pressure signal, and is comprised of pistons (5, 6) for third shaft (33) disposed in correspondence with an operation object corresponding to the third shaft (33), twisting means (13, 14, 15) for twisting the operation lever (8) about lever axis 8*a*, and conversion means (18, 19) for converting the movement to twist the operation lever (8) about the lever axis (8*a*) into motion to move the third-shaft pistons (5, 6).

The second aspect of the invention will be described specifically with reference to FIG. 2.

According to the second aspect of the invention, when the operation lever 8 is tilted, the pistons 1, 2, 3, 4 are moved, the oil pressure signal is output according to the movements of the pistons 1, 2, 3, 4, and the control valves 31, 32 are operated according to the oil pressure signal.

When the operation lever 8 is twisted about the lever axis 8*a*, the shaft 13 supported by bearings 14, 15 is twisted. The twist of the shaft 13 is converted into the movement in a direction to move the pistons 5, 6 by the first lever 18 and the second lever 19, and the pistons 5, 6 are moved. When the pistons 5, 6 are moved, the oil pressure signal is output from discharge ports 25, 26. The control valve 33 is operated according to the oil pressure signal.

According to the second aspect of the invention, the same effects as those by the first aspect of the invention can be obtained. According to the second aspect of the invention, there is provided an effect that operation objects (control valves 31, 32, 33) of three axes can be operated by a single hydraulic operation lever 8.

A third aspect of the invention is an operation lever device which is provided with tilting fulcrum (11) for supporting the root of operation lever (8) and tilting the operation lever (8), moves pistons (1, 2) according to the tilting operation of the operation lever (8), outputs an oil pressure signal according to the movement of the pistons (1, 2), and operates operation object (31) according to the oil pressure signal, and is provided with twisting means (13, 14, 15) for twisting the operation lever (8) about the lever axis (8*a*), and conversion means (18, 19) for converting the movement to twist the operation lever (8) about the lever axis (8*a*) into movement to move pistons (5, 6), wherein the twisting means (13, 14, 15) and the conversion means (18, 19) are disposed on the other side of the operation lever (8) with the tilting fulcrum (11) therebetween.

The third aspect of the invention will be described specifically with reference to FIG. 2.

According to the third aspect of the invention, twisting mechanism for twisting the operation lever 8 and conversion mechanisms (the shaft 13, the bearings 14, 15, the first lever 18, the second lever 19, etc.) for converting to the movement for moving the pistons 5, 6 are disposed below the universal joint 11 which supports the root of the operation lever 8 and tilts the operation lever 8.

According to the third aspect of the invention, even when the operation lever 8 is tilted, its movement does not give an effect on the movements of the mechanisms below the universal joint 11. Therefore, the twisting mechanism and the conversion mechanism can be configured independent of the tilting of the operation lever 8, and the structure can be made simple.

In order to achieve the second object, a fourth aspect of the invention is an operation lever device which is provided with the disk plate (9) to which the root of the operation lever (8) is attached and the tilting fulcrum (11) which tiltably supports the disk plate (9), moves the pistons (1, 2) via the disk plate (9) according to the tilting operation of the operation lever (8), and outputs a signal according to the movements of the pistons (1, 2) to operate the operation object (31) according to the signal, wherein:

- the disk plate (9) is separated into a first disk plate (9*a*) to which the root of the operation lever (8) is attached and a second disk plate (9*b*) which is tiltably supported by a tilting fulcrum (11);
- twisting means (13, 50, 51) are disposed to twist the first disk plate (9*a*) about the lever axis (8*a*) of the operation lever (8) independent of the second disk plate (9*b*); and
- a signal corresponding to the twisted position of the first disk plate (9*a*) about the lever axis (8*a*) is output to operate the operation object (33) according to the signal.

The fourth aspect of the invention will be described with reference to FIG. 20.

According to the fourth aspect of the invention, the disk plate 9 is separated into the first disk plate 9*a* to which the root of the operation lever 8 is attached and a second disk plate 9*b* which is tiltably supported by a tilting fulcrum 11. And, the first disk plate 9*a* becomes independent from the second disk plate 9*b* and twists about the lever axis 8*a* of the operation lever 8.

According to the fourth aspect of the invention, when the operation lever 8 is twisted, only the first disk plate 9*a* is twisted about the lever axis 8*a* independent of the second disk plate 9*b*, so that the twist about the lever axis 8*a* of the operation lever 8 is not affected by the frictional force produced between the second disk plate 9*b* and the top end 12*a* of the plate 12.

Therefore, when the hand is moved off the operation lever 8 after twisting it, the operation lever 8 returns to the original neutral position smoothly.

A fifth aspect of the invention is an operation lever device which outputs a signal according to the operation of the operation lever (8) to operate the operation object (33) according to the signal, which comprises:

the twisting means (13, 14, 15) for twisting the operation lever (8) about the lever axis **(8*a*) from its neutral twisting position to a predetermined twisting position, and elastic member (52) for returning the operation lever (8) to its neutral twisting position when the operation lever (8) is twisted about the lever axis (8*a*)**.

The fifth aspect of the invention will be described with reference to FIG. 20.

According to the fifth aspect of the invention, when the operation lever 8 is twisted about the lever axis **8*a*, the operation lever 8 is returned to its neutral twisting position by means of the elasticity of the elastic member 52**.

Therefore, when the hand is moved off the operation lever 8 after it is twisted, the operation lever 8 is returned smoothly to its original neutral position.

A sixth aspect of the invention is an operation lever device which is provided with the disk plate (9) to which the root of the operation lever (8) is attached and the tilting fulcrum (11) which tiltably supports the disk plate (9), moves the pistons (1, 2) via the disk plate (9) according to the tilting operation of the operation lever (8), and outputs a signal according to the movements of the pistons (1, 2) to operate the operation object (31) according to the signal, wherein:

the disk plate (9) is separated into a first disk plate **(9*a*) to which the root of the operation lever (8) is attached and a second disk plate (9*b*) which is tiltably supported by the tilting fulcrum (11)**;

twisting means (13, 50, 51) are disposed to twist the first disk plate **(9*a*) about the lever axis (8*a*) of the operation lever (8) independent of the second disk plate (9*b*)** from the neutral twisting position to a predetermined twisting position;

elastic member (52) is disposed to return the first disk plate **(9*a*) to the neutral twisting position when the first disk plate (9*a*) is twisted about the lever axis (8*a*), and a signal is output according to the twisting position of the first disk plate (9*a*) about the lever axis (8*a*) to operate the operation object (33)** according to the signal.

A sixth aspect of the invention is a combination of the fourth aspect of the invention and the fifth aspect of the invention.

A seventh aspect of the invention is the operation lever device according to the fourth aspect of the invention or the sixth aspect of the invention, wherein the first disk plate **(9*a*) is twistably supported by the second disk plate (9*b*) through a bearing (53)**.

DETAILED DESCRIPTION OF THE PREFERRED EMBODIMENTS

Referring to the accompanying drawings, embodiments of the operation lever device of the present invention will be described. Those embodiments are directed to the operation lever device for operating the blade of a bulldozer.

Figure 1:
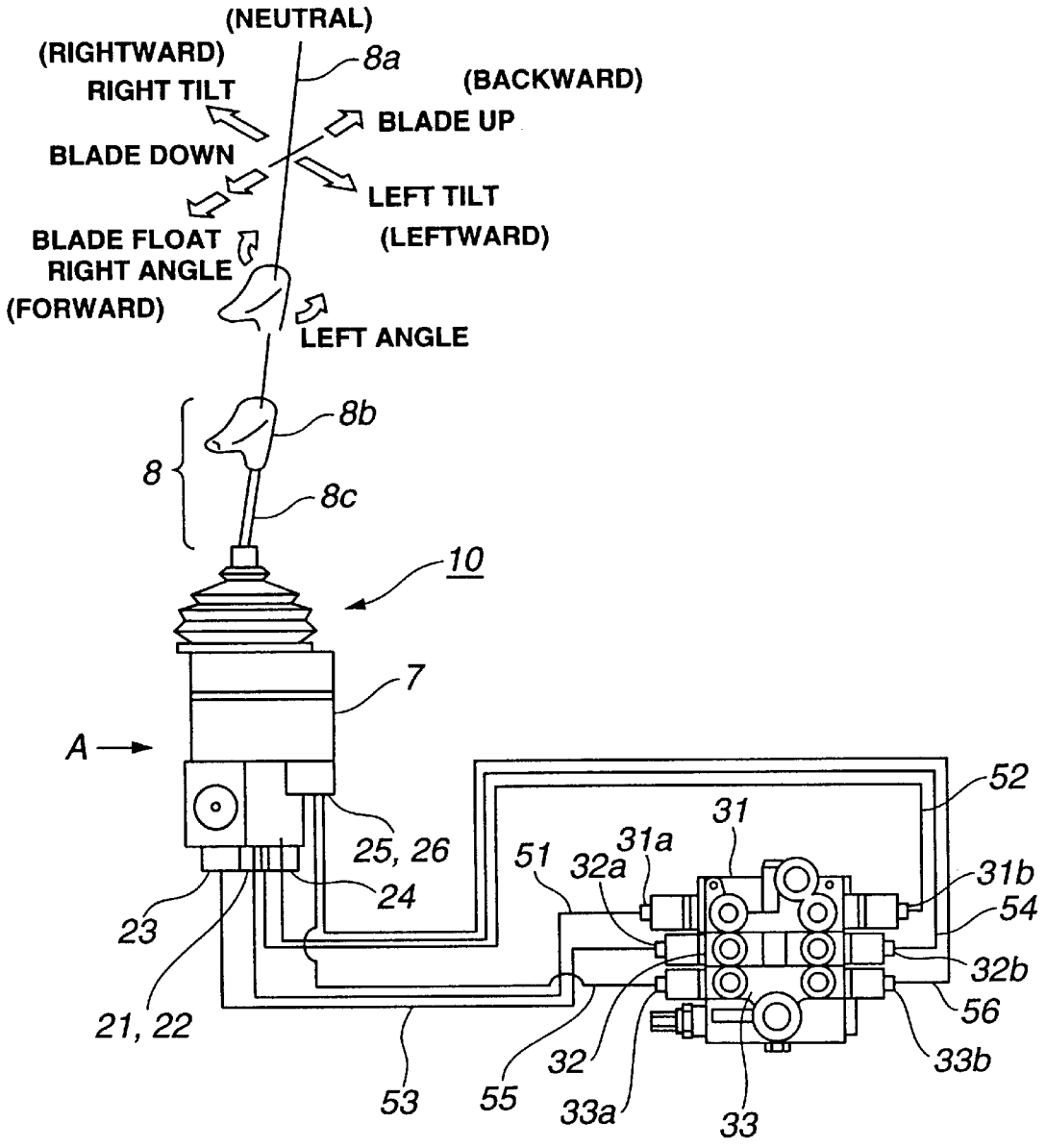
FIG. 1 is an entire structure diagram of a first embodiment.

FIG. 1 shows a relation between the operation lever device 10 of the first embodiment and the control valves 31, 32, 33 to be operated.

The operation lever device 10 is comprised of the operation lever 8 and body 7. The operation lever 8 is comprised of grip **8*b* to be held by an operator and the shaft section 8*c* which has the grip 8*b* on its upper end. The shaft section 8*c* has its root supported by the body 7 so to be freely tilted. The center axis of the shaft section 8*b* is lever axis 8*a***.

Specifically, the operation lever 8 can be tilted in right and left directions. The operation lever 8 can also be tilted in back and forth directions. Besides, the operation lever 8 can be twisted clockwise or counterclockwise about the lever axis **8*a***.

Discharge ports 21–26 are disposed at the lower part of the body 7 in order to output an oil pressure signal (pilot pressure).

When the operation lever 8 is tilted to the left from its neutral position, the oil pressure signal (pilot pressure) is output from the discharge port 21. When the operation lever 8 is tilted to the right from its neutral position, the oil pressure signal is output from the discharge port 22. When the operation lever 8 is tilted to the front from its neutral position, the oil pressure signal is output from the discharge port 23. When the operation lever 8 is tilted to the back from its neutral position, the oil pressure signal is output from the discharge port 24. When the operation lever 8 is twisted counterclockwise from its neutral position, the oil pressure signal is output from the discharge port 25. When the operation lever 8 is twisted clockwise from its neutral direction, the oil pressure signal is output from the discharge port 26.

The respective discharge ports 21, 22 are connected to pilot ports 31*a*, 31*b* of the control valve 31 through pipes 51, 52. The discharge ports 23, 24 are connected to pilot ports 32*a*, 32*b* of the control valve 32 through pipes 53, 54, respectively. The respective discharge ports 25, 26 are connected to pilot ports 33*a*, 33*b* of the control valve 33 through pipes 55, 56.

The control valve 31 is connected to a hydraulic cylinder which operates the blade in left-tilt and right-tilt directions. When the pilot pressure is applied to the pilot port 31*a* of the control valve 31, the pressure oil having a flow rate corresponding to the pilot pressure is supplied to one of cylinder chambers of the hydraulic cylinder to tilt the blade to the left. Similarly, when the pilot pressure is applied to the pilot port 31*b* of the control valve 31, the pressure oil having a flow rate corresponding to the pilot pressure is supplied to the other cylinder chamber of the hydraulic cylinder to tilt the blade to the right.

The control valve 32 is connected to the hydraulic cylinder which operates the blade in up and down (floating) directions. When the pilot pressure is applied to the pilot port 32*a* of the control valve, the pressure oil having a flow rate corresponding to the pilot pressure is supplied to one of the cylinder chambers of the hydraulic cylinder to operate the blade in the down (floating) direction. Similarly, when the pilot pressure is applied to the pilot port 32*b* of the control valve 32, the pressure oil having a flow rate corresponding to the pilot pressure is supplied to the other cylinder chamber of the hydraulic cylinder to operate the blade in the up direction.

The control valve 33 is connected to the hydraulic cylinder which operates the blade in left-angle and right-angle directions. When the pilot pressure is applied to the pilot port 33*a* of the control valve 33, the pressure oil having a flow rate corresponding to the pilot pressure is supplied to one of the cylinder chambers of the hydraulic cylinder to left-angle the blade. Similarly, when the pilot pressure is applied to the pilot port 33*b* of the control valve 33, the pressure oil having a flow rate corresponding to the pilot pressure is supplied to the other cylinder chamber of the hydraulic cylinder to right-angle the blade.

When the operation lever 8 is tilted in the left direction as described above, the blade is tilted to the left, when it is tilted in the right direction, the blade is tilted to the right, when it is tilted in the forward direction, the blade is operated in the down direction (floating direction), when it is tilted in the back direction, the blade is operated in the upward direction, when it is twisted to the left, the blade is left-angled, and when it is twisted to the right, the blade is right-angled.

The structure of the operation lever device 10 will be described with reference to FIG. 2, FIG. 3 and FIG. 4.

Figure 2:
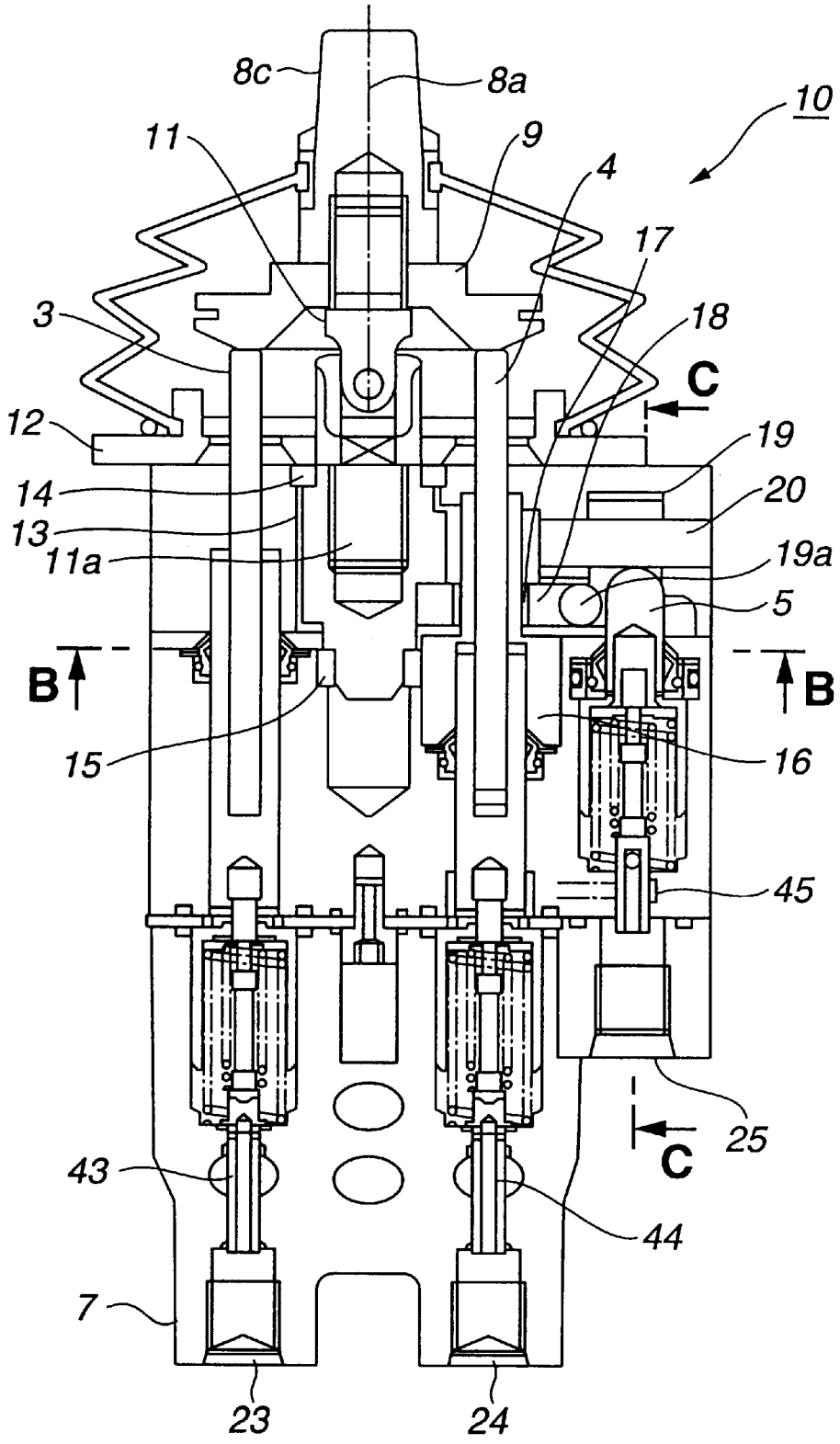
FIG. 2 is a vertical sectional diagram of an operation lever device viewed in a direction vertical to the sheet of FIG. 1.

FIG. 2 is a vertical sectional diagram of the operation lever device 10 viewed in a direction perpendicular to the sheet of FIG. 1.

As shown in FIG. 2, the disk plate 9 is attached to the root of the shaft section 8*c* of the operation lever 8. The plate 12 is disposed on the top surface of the body 7. The disk plate 9 is disposed above the plate 12.

The shaft section 8*c* (disk plate 9) is connected to the shaft 13 via universal joint 11. The shaft 13 is disposed on the same axis as the lever axis 8*a* when the operation lever 8 is in its neutral position. By the above connection, the shaft 13 is twisted when the operation lever 8 is twisted. And, when the operation lever 8 is twisted in its tilted state, the shaft 13 is similarly twisted through the universal joint 11.

The bottom of the disk plate 9 is connected to the top end of the universal joint 11. The universal joint 11 is twistably fitted to the plate 12. The top end of the shaft 13 is connected to the bottom end of the universal joint 11. Specifically, thread section 11*a* of the universal joint 11 is screwed into the shaft 13 to fix mutually.

Therefore, the shaft section 8*c* of the operation lever 8 can be tilted freely in right and left or back and forth directions on the upper part of the plate 12. Besides, the shaft 13 can be twisted by twisting the operation lever 8 about the lever axis 8*a*.

Figure 3:
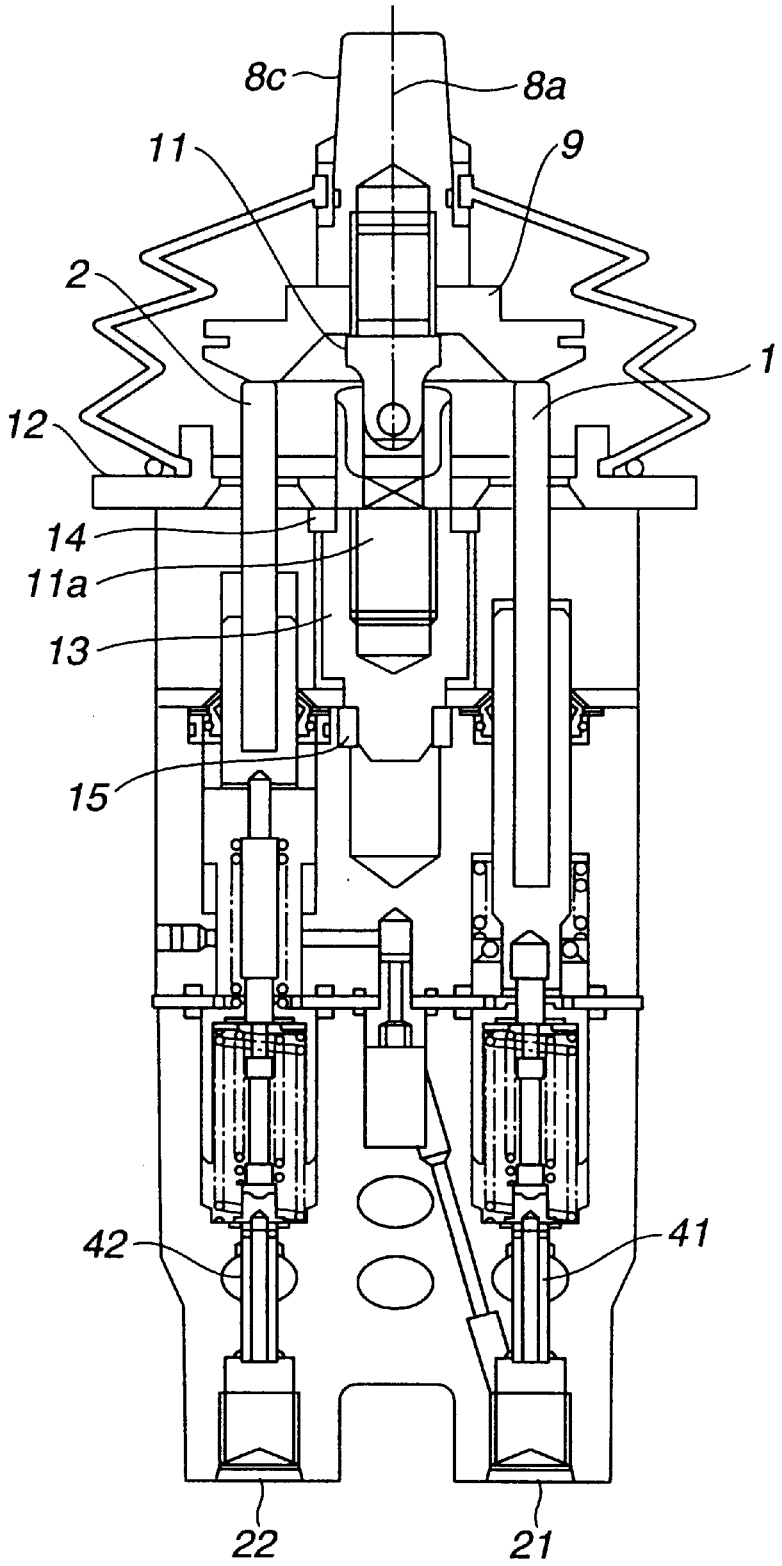
FIG. 3 is a vertical section diagram of the operation lever device viewed in a direction of arrow A of FIG. 1.

FIG. 3 is a vertical sectional diagram of the operation lever device 10 viewed in a direction of arrow A of FIG. 1. It is apparent from FIG. 2 and FIG. 3 that the pistons 1, 2, 3, 4 are disposed on the body 7 so that the leading ends of the pistons are protruded from the plate 12 so to come in contact with the bottom surface of the disk plate 9. The pistons 1, 2, 3, 4 are provided with pressure reducing valves 41, 42, 43, 44 respectively. When the operation lever 8 is tilted and the disk plate 9 is tilted accordingly, the pistons 1, 2, 3, 4 are displaced downward in the drawing. The pressure reducing valves 41, 42, 43, 44 are increased their predetermined pressures as the pistons 1, 2, 3, 4 are moved downward. Inlet ports of the pressure reducing valves 41 to 44 are connected to a hydraulic pump (not shown) for the operation lever. And, the discharge ports of the pressure reducing valves 41 to 44 are formed as discharge ports 21 to 24 at the bottom of the body 7.

The pressure oil supplied from the hydraulic pump for the operation lever to the pressure reducing valves 41 to 44 is lowered its pressure by the pressure reducing valves 41 to 44 to a predetermined level according to the tilted amount of the operation lever 8 and discharged from the discharge ports 21 to 24.

Therefore, when the operation lever 8 is tilted to the left, the piston 1 is moved downward, and the pilot pressure oil having a pressure corresponding to the tilted amount of the lever is output from the discharge port 21. Thus, the pilot pressure is applied to the pilot port 31*a* of the control valve 31 to tilt the blade to the left.

When the operation lever 8 is tilted to the right, the piston 2 is moved down, and the pilot pressure oil having a pressure corresponding to the tilted amount of the lever is output from the discharge port 22. Thus, the pilot pressure is applied to the pilot port 31*b* of the control valve 31, and the blade is tilted to the right.

When the operation lever 8 is tilted forward, the piston 3 is moved downward, and the pilot pressure oil having a pressure corresponding to the tilted amount of the lever is output from the discharge port 23. Thus, the pilot pressure is applied to the pilot port 32*a* of the control valve 32, and the blade is operated downward (floating direction).

When the operation lever 8 is tilted backward, the piston 4 is moved downward, and the pilot pressure oil having a pressure corresponding to the tilted amount of the lever is output from the discharge port 24. Thus, the pilot pressure is applied to the pilot port 32*b* of the control valve 32, and the blade is operated upward.

Figure 4:
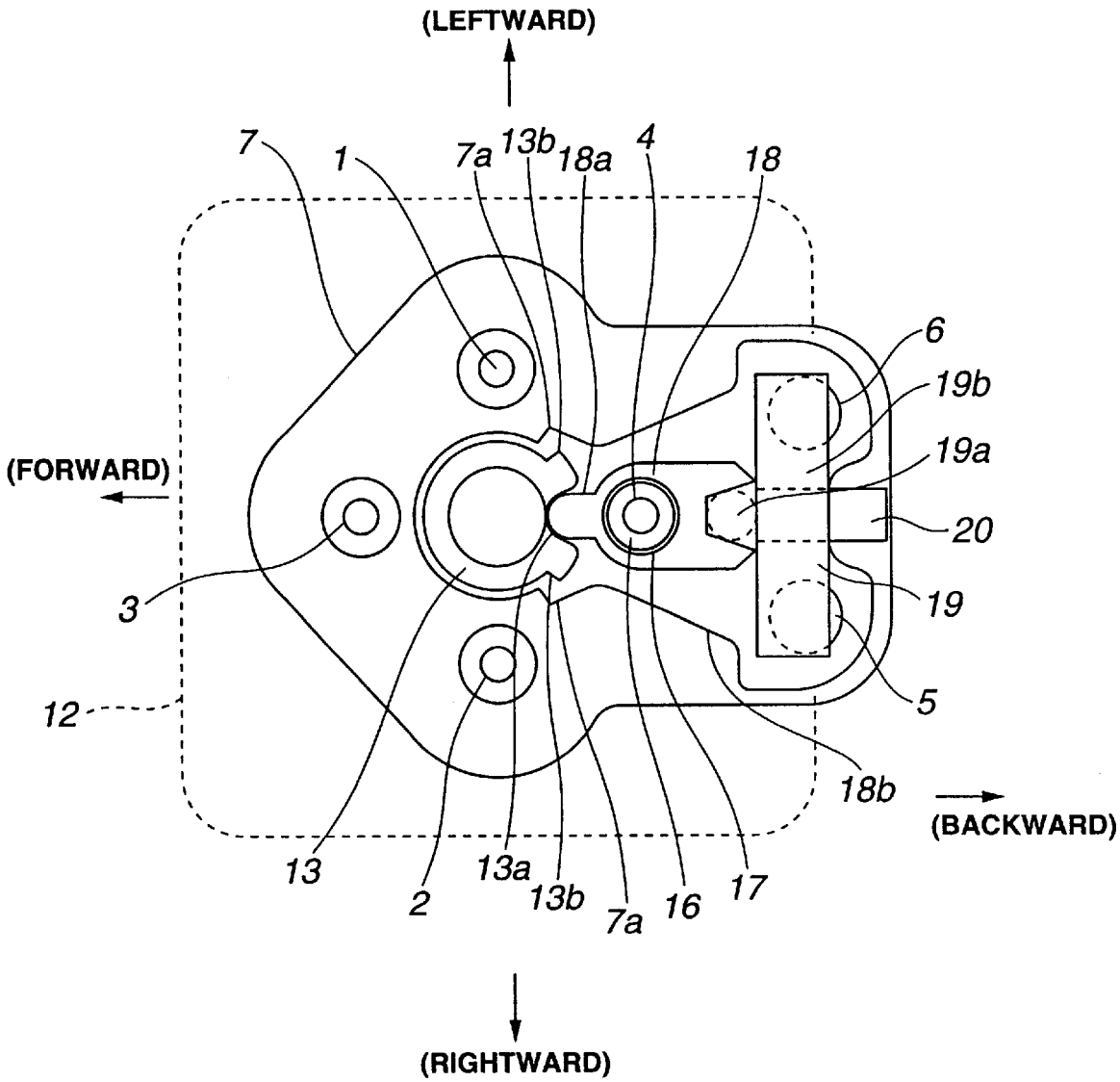
FIG. 4 is a sectional diagram taken along line B—B of FIG. 2.

FIG. 4 is a sectional diagram taken along line B—B of FIG. 2.

As shown in FIG. 4, the pistons 5, 6 are disposed in parallel with the pistons 1 to 4 in the body 7. The pistons 5, 6 are provided with pressure reducing valves 45, 46 respectively. The predetermined pressures of the pressure reducing valves 45, 46 are increased as the pistons 5, 6 are moved downward. Inlet ports of the pressure reducing valves 45, 46 are connected to the hydraulic pump for the operation lever in the same way as the pressure reducing valves 41 to 44. Respective outlet ports of the pressure reducing valves 45, 46 are formed as the discharge ports 25, 26 on the lower part of the body 7.

Movement to twist the shaft 13 is converted into movement to lower the pistons 5, 6 through the first lever 18 and the second lever 19.

Specifically, recess 13*a* is formed along the outer periphery of the shaft 13. Projection 18*a* which is engaged with the recess 13*a* of the shaft 13 is formed on the first lever 18.

The projection 18*a* of the first lever 18 is engaged with the recess 13*a* of the shaft 13. The first lever 18 is mounted around the piston 4 through sleeve 16 and bush 17 so to twist with the piston 4 as a twisting fulcrum. Therefore, when the shaft 13 is twisted, its twisting force is transmitted from the recess 13*a* of the shaft 13 to the projection 18*a* of the first lever 18, and the first lever 18 is twisted about the piston 4. The center of the piston 4 and the twisting center of the first lever 18 are the same. In other words, the first lever 18 is twisted about the piston 4.

Stoppers 13*b* are formed on the shaft 13. Contact surfaces 7*a* are formed on the body 7 so to come into contact with the stoppers 13*b* with which the stoppers 13 come in contact. When the shaft 13 is twisted, the stopper 13*b* comes in contact with the contact surface 7*a* of the body 7 to restrict the movement of the shaft 13. In other words, the twisting amount of the operation lever 8 is restricted.

Figure 5A:
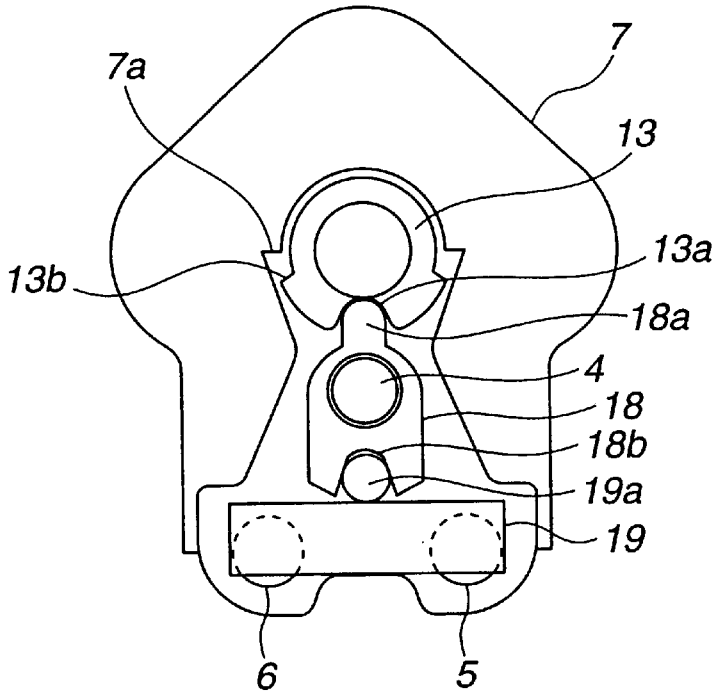
FIG. 5(*a*) is a diagram viewed in a direction of arrow D of FIG. 5(*b*), and FIG. 5(*b*) is a sectional diagram taken along line C—C of FIG. 2.
Figure 5B:
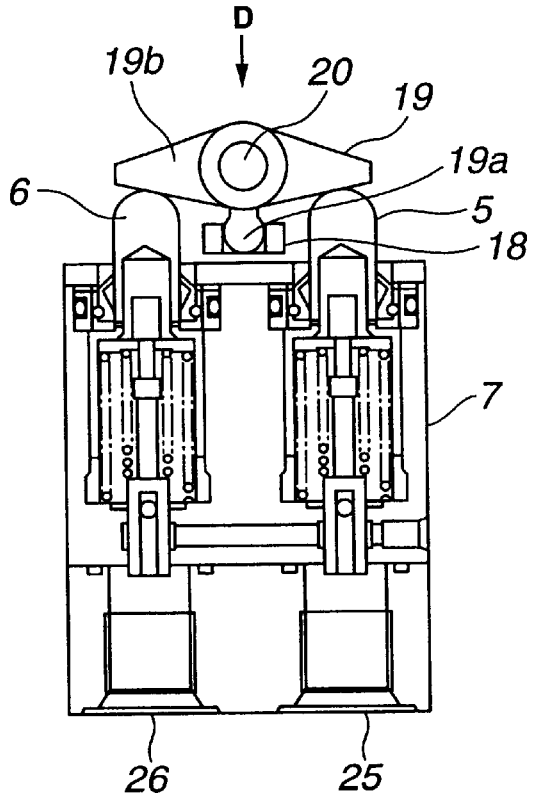

FIG. 5(*b*) is a sectional diagram taken along line C—C of FIG. 2. FIG. 5(*a*) is a top view seen in a direction of arrow D of FIG. 5(*b*). Pin 20 is omitted from FIG. 5(*a*). FIGS. 5(*a*) and 5(*b*) show that the operation lever 8 is in its neutral position.

As shown in FIG. 5(*b*), recess 18*b* is formed on a position opposite to the projection 18*a* of the first lever 18. Meanwhile, the second lever 19 is comprised of rocker arm 19*b* whose bottom surface is in contact with the top ends of the pistons 5, 6 and projection 19*a* which is engaged with the recess 18*b* of the first lever 18.

In the body 7, pin 20 is disposed vertically relative to the arranged directions (vertical directions) of the pistons 5, 6. The rocker arm 19*b* of the second lever 19 is fitted so to rock about the pin 20.

The projection 19*a* of the second lever 19 is engaged with the recess 18*b* of the first lever 18. Therefore, when the first lever 18 is twisted about the piston 4, the twisting force of the first lever 18 is transmitted from the recess 18*b* of the first lever 18 to the projection 19*a* of the second lever 19, and the rocker arm 19*b* is rocked about the pin 20. When the rocker arm 19*b* is rocked, the piston 5 or 6 is moved downward according to the rocking direction.

Figure 6A:
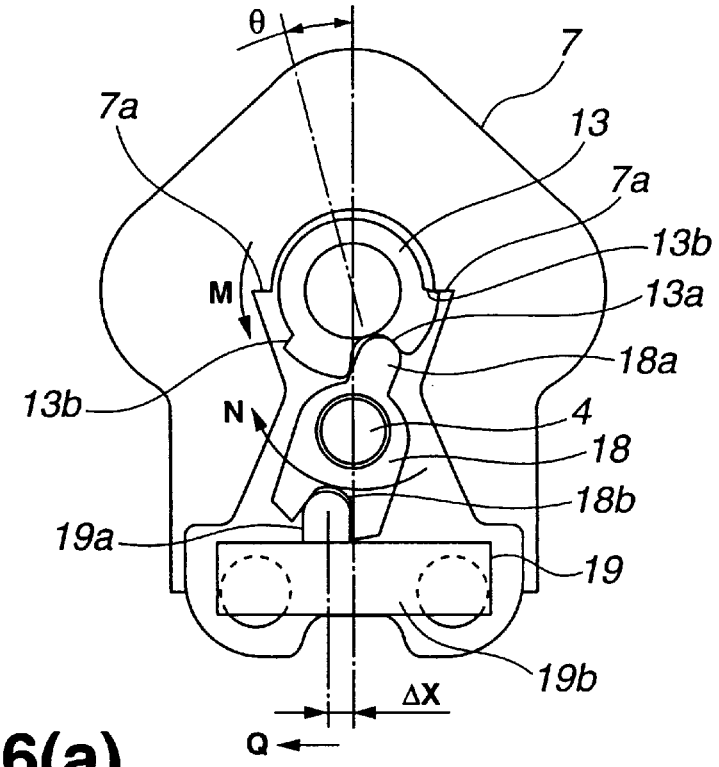
FIG. 6(*a*) is a diagram viewed in a direction of arrow D of FIG. 6(*b*), and FIG. 6(*b*) is a sectional diagram taken along line C—C of FIG. 2.
Figure 6B:
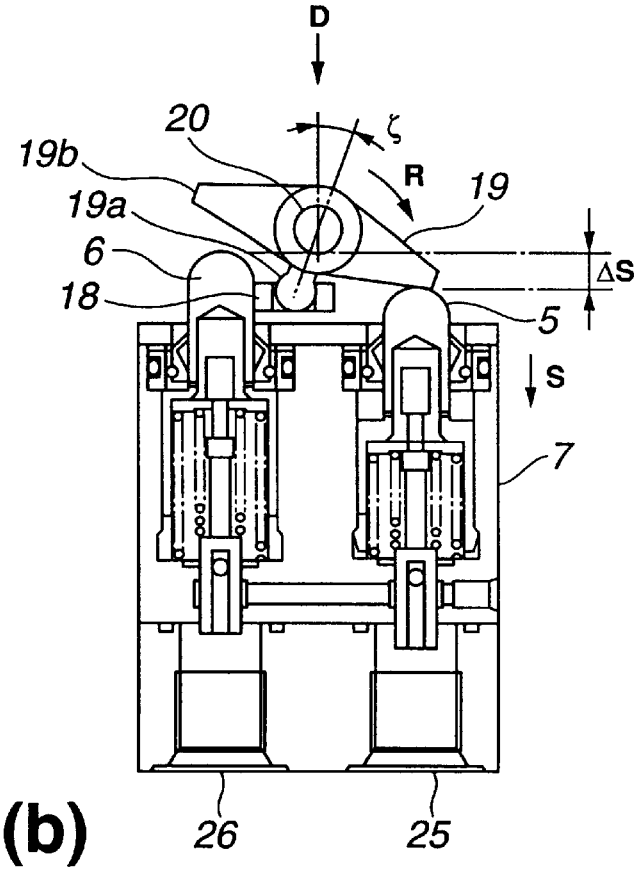

Similarly, FIGS. 6(*a*) and 5(*b*) show that the operation lever 8 is twisted. Respective members correspond to those shown in FIGS. 5(*a*) and 5(*b*). FIGS. 6(*a*) and 6(*b*) show a state that the operation lever 8 is twisted from its neutral position to the left (left angle).

Referring to FIGS. 5(*a*) and 5(*b*) and FIGS. 6(*a*) and 6(*b*), the operation that the operation lever 8 is twisted to the left will be described.

As shown in FIG. 6(*a*), when the operation lever 8 is moved by angle $\theta$ from its neutral position in direction M (counterclockwise direction in the drawing), the shaft 13 is twisted in the direction M, and the twisting force of the shaft 13 is transmitted from the recess 13*a* of the shaft 13 to the projection 18*a* of the first lever 18. Thus, the first lever 18 is twisted in right direction N about the piston 4.

When the first lever 18 is twisted in the right direction N about the piston 4, the twisting force of the first lever 18 is transmitted from the recess 18*b* of the first lever 18 to the projection 19*a* of the second lever 19. Thus, the projection 19*a* of the second lever 19 is moved as indicated by arrow Q from its neutral position to the left by displaced amount $\Delta X$ corresponding to the twisting angle $\theta$. When the projection 19*a* of the second lever 19 is moved in the left direction Q, the rocker arm 19*b* of the second lever 19 is rocked in right direction R about the pin 20 by rocking angle $\Psi$ corresponding to the displaced amount $\Delta X$ as shown in FIG. 6(*b*).

When the rocker arm 19*b* is rocked in right direction R, the piston 5 is moved in lower direction S by displaced amount $\Delta S$ corresponding to the rocking angle $\Psi$. When the piston 5 moves in the lower direction S, the pilot pressure oil having a pressure corresponding to the displaced amount $\Delta S$ is discharged from the discharge port 25. Therefore, the blade is finally left-angled at a moving speed corresponding to the twisting operation amount $\theta$ of the operation lever 8. The operation lever 8 can be twisted to such a level that the stopper 13*b* of the shaft 13 comes in contact with the contact surface 7*a* of the body 7.

When the operation lever 8 is twisted in the right direction, the rocker arm 19*b* of the second lever 19 is rocked in the left direction in FIG. 6(*b*). Thus, the piston 6 is moved downward, the pilot pressure oil is output from the discharge port 26 accordingly, and the blade is right-angled.

As described above, in order to output the oil pressure signal by the twisting operation of the operation lever 8 according to this embodiment, it is sufficient by providing the operation lever device 10 with a mechanism to twist the operation lever 8 and a mechanism to convert the twist into motion to move the piston 6. Thus, different from a conventional electric operation lever device, the sensor, the controller, etc. need not be installed, and the structure can be made simple.

Besides, the spool of the flow rate control valve is not directly pushed or pulled by a link mechanism but the structure to output the oil pressure signal according to the movement of the piston is followed in the same way as the conventional hydraulic operation lever device, so that the operation lever device is readily assembled and adjusted without requiring large lots of time. In the same way as the conventional hydraulic operation lever device, it also has the pilot hydraulic type structure to move the piston by operating the operation lever. Therefore, the force to operate the operation lever is small as in the case of the prior art, and the operator is free from getting tired. Furthermore, the arrangements of the operation lever and the flow rate control valve are not restricted because the operation lever and the spool of the flow rate control valve are not connected by a like mechanism but the structure to output the oil pressure signal according to the movement of the piston is followed in the same way as the conventional hydraulic operation lever device.

In addition, according to this embodiment, a twisting mechanism for twisting the operation lever 8 and a conversion mechanism (including the shaft 13, the bearings 14, 15, the first lever 18, and the second lever 19) which converts to motion to move the pistons 5, 6 are disposed below the universal joint 11 which supports the root of the operation lever 8 and tilts the operation lever 8. Thus, according to this embodiment, even if the operation lever 8 is tilted, its movement does not affect the movement of the mechanism below the universal joint 11. Therefore, the twisting mechanism and the conversion mechanism can be configured independent of the mechanism for tilting the operation lever 8, and the structure can be made simple.

In this embodiment, the first lever 18 is twisted about the piston 4, but it may be configured to twist about the pistons 1 to 3.

The operation lever device 10 of this embodiment is assumed that the operation lever 8 can be tilted freely in two directions of back and forth and right and left. And, the twisting mechanism for twisting the operation lever 8 is added to the operation lever device 10 which can be tilted freely in the two directions.

But, the present invention can also be applied to add a twisting mechanism to the operation lever device 10 which can freely tilt the operation lever 8 in one direction of right and left or back and forth.

The operation lever device 10 of a second embodiment which is provided with a conversion mechanism different from the one of the first embodiment will be described.

Figure 7:
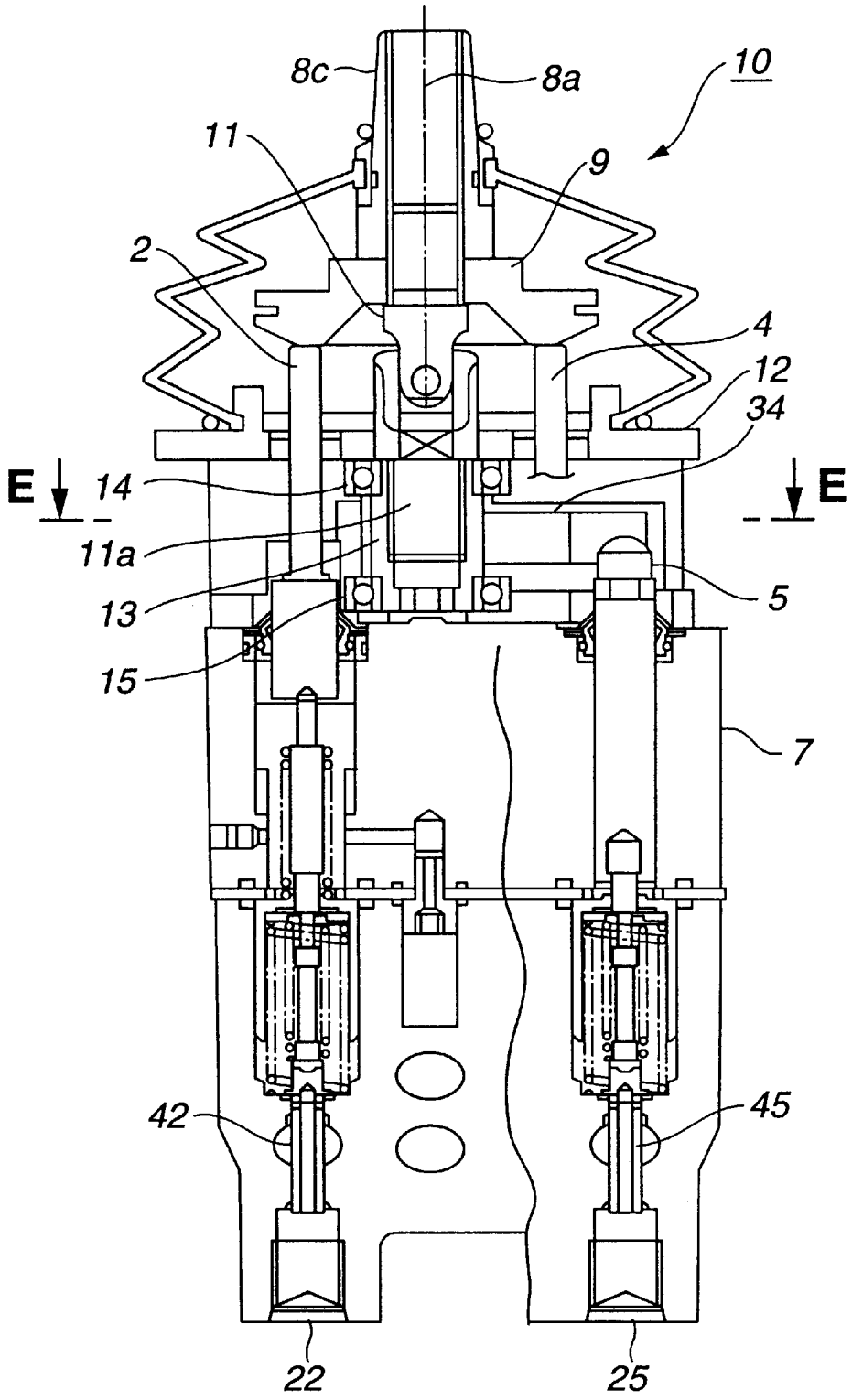
FIG. 7 is a vertical sectional diagram of the operation lever device of a second embodiment.

FIG. 7 is a sectional diagram of the operation lever device 10 of the second embodiment. Like reference numerals are used to indicate like components as those shown in FIG. 2 and their descriptions are omitted.

As shown in FIG. 7, the shaft 13 is provided with arm 34 which is extended vertically (the right direction in the drawing) in the axial direction (vertical direction in the drawing) of the shaft 13. The shaft 13 is integrally formed with the arm 34.

The motion to twist the shaft 13 is converted into the motion to move the pistons 5, 6 downward through the arm 34.

Figure 8A:
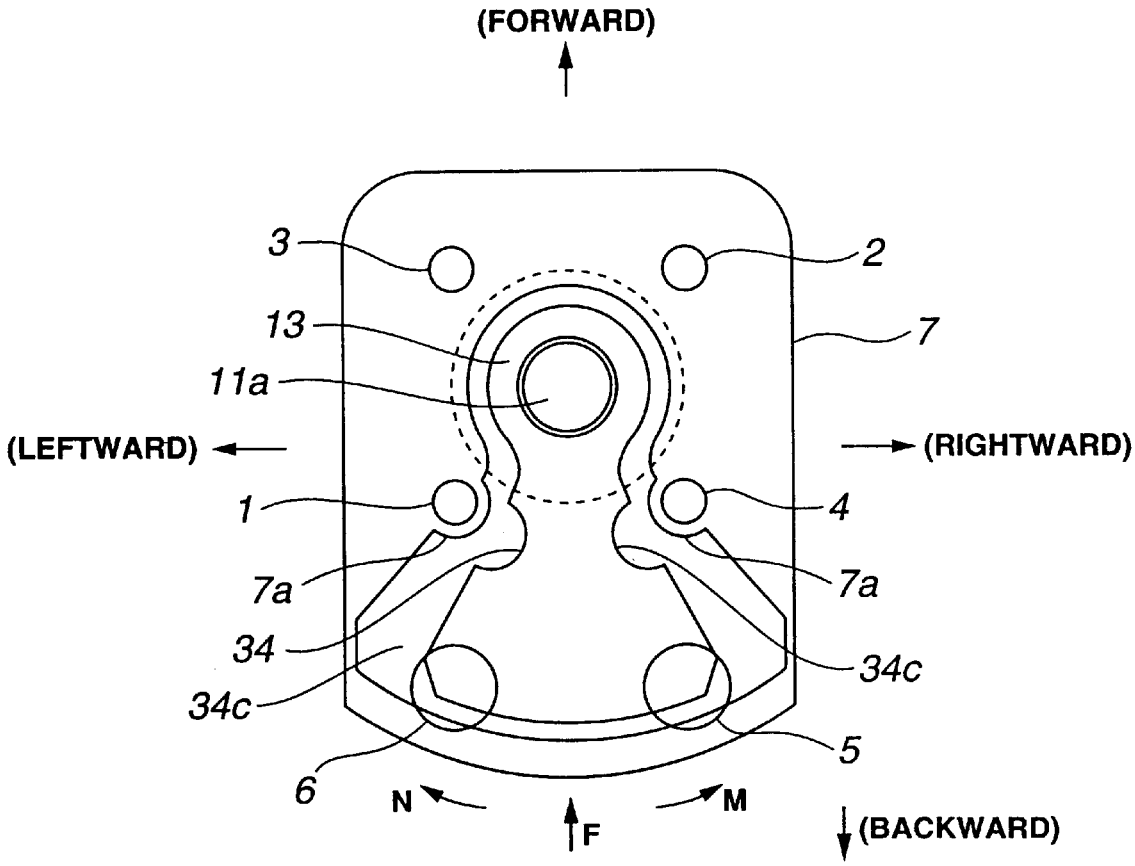
FIG. 8(*a*) is a sectional diagram taken along line E—E of FIG. 7, and FIG. 8(*b*) is a diagram viewed in a direction of arrow F of FIG. 8(*a*)
Figure 8B:
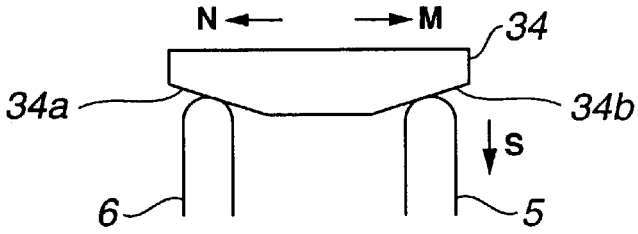

FIG. 8(*a*) is a sectional diagram taken along line E—E of FIG. 7. FIG. 8(*b*) is a diagram viewed in a direction of arrow F in FIG. 8(*a*).

Specifically, taper faces 34*a*, 34*b* are formed on the bottom surface of the arm 34. The top end of the piston 5 is in contact with the taper face 34*b*. The top end of the piston 6 is in contact with the taper face 34*a*. The taper face 34*b* is designed to have a slope so that the piston 5 can be pushed downward by twisting the operation lever 8 in left direction M. The taper face 34*a* is designed to have a slope to push down the piston 6 by twisting the operation lever 8 in right direction N.

Stoppers 34*c* are formed on the arm 34. Contact surfaces 7*a* to which the stoppers 34*c* come in contact are formed on the body 7. When the shaft 13 is twisted, the stoppers 34*c* come in contact with the contact surfaces 7*a* of the body 7 to restrict the movement of the shaft 13.

As shown in FIG. 8(*a*), the second embodiment is different from the first embodiment and has the pistons 3, 1 on the left side of the operation lever device 10, the pistons 2, 4 on the right side, the pistons 2, 3 on the front side, and the pistons 1, 4 on the back side. In FIG. 1, the hydraulic circuits are configured so that when the oil pressure signal is output from the discharge ports 23, 21, the pilot pressure is applied to the pilot port 31*a* of the control valve 31, when the oil pressure signal is output from the discharge ports 22, 24, the pilot pressure is applied to the pilot port 31*b* of the control valve 31, when the oil pressure signal is output from the discharge ports 22, 23, the pilot pressure is applied to the pilot port 32*a* of the control valve 32, and when the oil pressure signal is output from the discharge ports 21, 24, the pilot pressure is applied to the pilot port 32*b* of the control valve 32.

Therefore, when the operation lever 8 is tilted in the left direction, the pistons 3, 1 are moved downward, and the pilot pressure oil having a pressure corresponding to the tilted amount of the lever is output from the discharge ports 23, 21. Thus, the pilot pressure is applied to the pilot port 31*a* of the control valve 31 to tilt the blade to the left.

When the operation lever 8 is tilted in the right direction, the pistons 2, 4 are moved downward, and the pilot pressure oil having a pressure corresponding to the tilted amount of the lever is output from the discharge ports 22, 24. Thus, the pilot pressure is applied to the pilot port 31*b* of the control valve 31 to tilt the blade to the right.

When the operation lever 8 is tilted forward, the pistons 2, 3 are moved downward, and the pilot pressure oil having a pressure corresponding to the tilted amount of the lever is output from the discharge ports 22, 23. Thus, the pilot pressure is applied to the pilot ports 32*a* of the control valve 32, and the blade is moved downward (floating direction).

When the operation lever 8 is tilted backward, the pistons 1, 4 are moved downward, and the pilot pressure oil having a pressure corresponding to the tilted amount of the lever is output from the discharge ports 21, 14. Thus, the pilot pressure is applied to the pilot port 32*b* of the control valve 32, and the blade is moved upward.

Then, the operation as the operation lever 8 is twisted to the left will be described with reference to FIG. 8.

When the operation lever 8 is twisted from its neutral position in left direction M, the shaft 13 is twisted in the same direction M, and the arm 34 which is integrally formed with the shaft 13 is twisted in the same direction M.

When the arm 34 is twisted in the right direction M, the piston 5 is pushed downward S by the taper surface 34*b*.

The pilot pressure oil having a pressure corresponding to the moved amount is discharged from the discharge port 25 when the piston 5 is moved downward S. Therefore, the blade is finally left-angled at a moving speed corresponding to the twisted amount of the operation lever 8. The operation lever 8 can be twisted to the twist position where the stopper 34*c* of the arm 34 comes in contact with the contact face 7*a* of the body 7.

When the operation lever 8 is twisted in right direction N, the arm 34 is similarly twisted in the right direction N. Thus, the piston 6 is pushed downward by the taper surface 34*a*, the pilot pressure oil is output from the discharge port 26 accordingly, and the blade is right-angled.

In the second embodiment, the relations between the positions of the pistons 1, 2, 3, 4 and the tilting directions of the operation lever 8 may be the same as in the first embodiment.

The operation lever device 10 of a third embodiment which is a modification of the second embodiment will be described.

Figure 9:
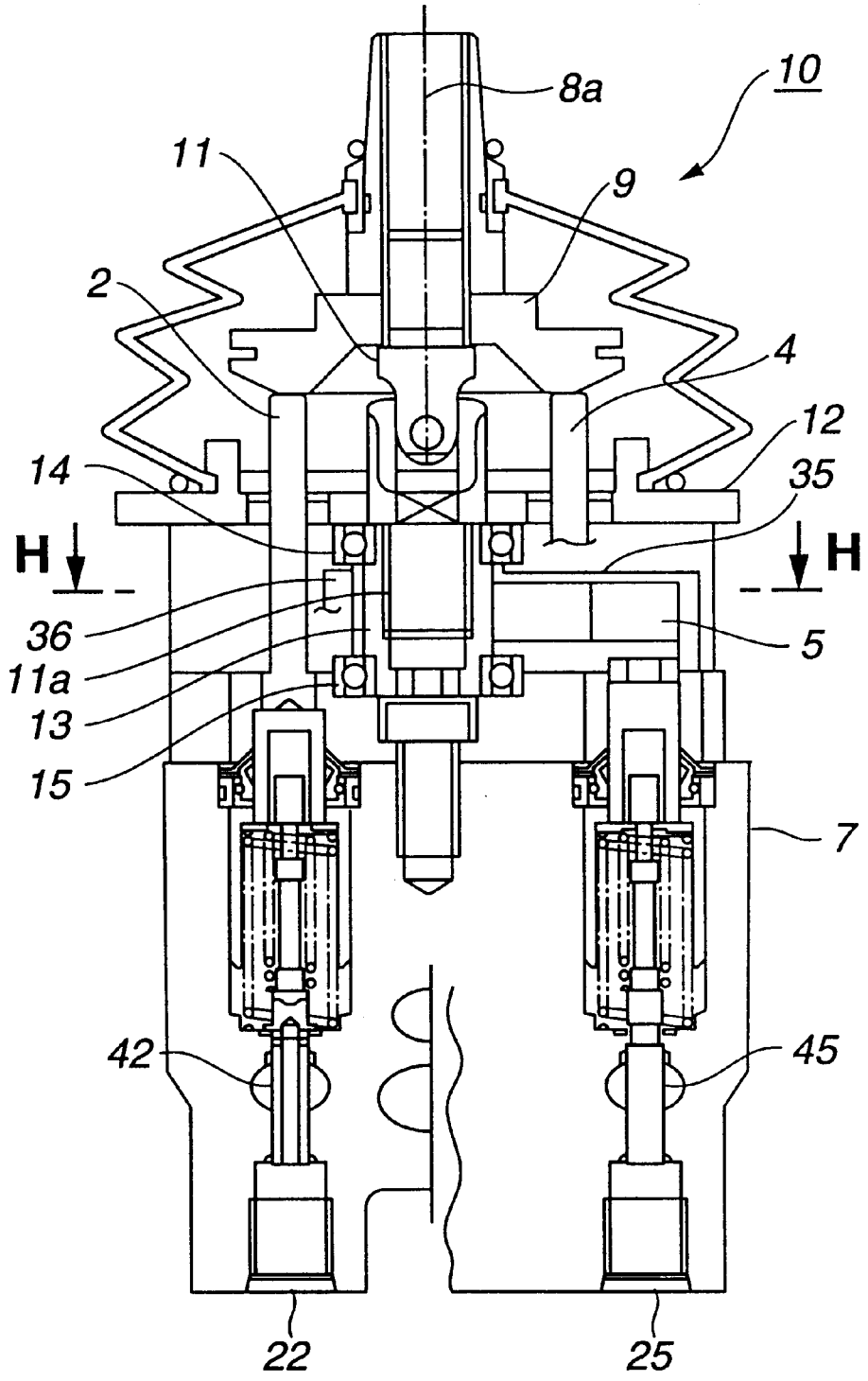
FIG. 9 is a vertical sectional diagram of the operation lever device of a third embodiment.

FIG. 9 is a vertical sectional diagram of the operation lever device 10 of the third embodiment. Like reference numerals are given to like components as those used in FIG. 2 and their descriptions are omitted.

As shown in FIG. 9, the shaft 13 is provided with arms 35, 36 which are extended in opposite directions (right and left directions in the drawing) with the axial direction (in the vertical direction) of the shaft 13 therebetween. The shaft 13 and the arms 35, 36 are integrally formed.

The motion to twist the shaft 13 is converted into motion to move the pistons 5, 6 downward through the arms 35, 36.

Figure 10A:
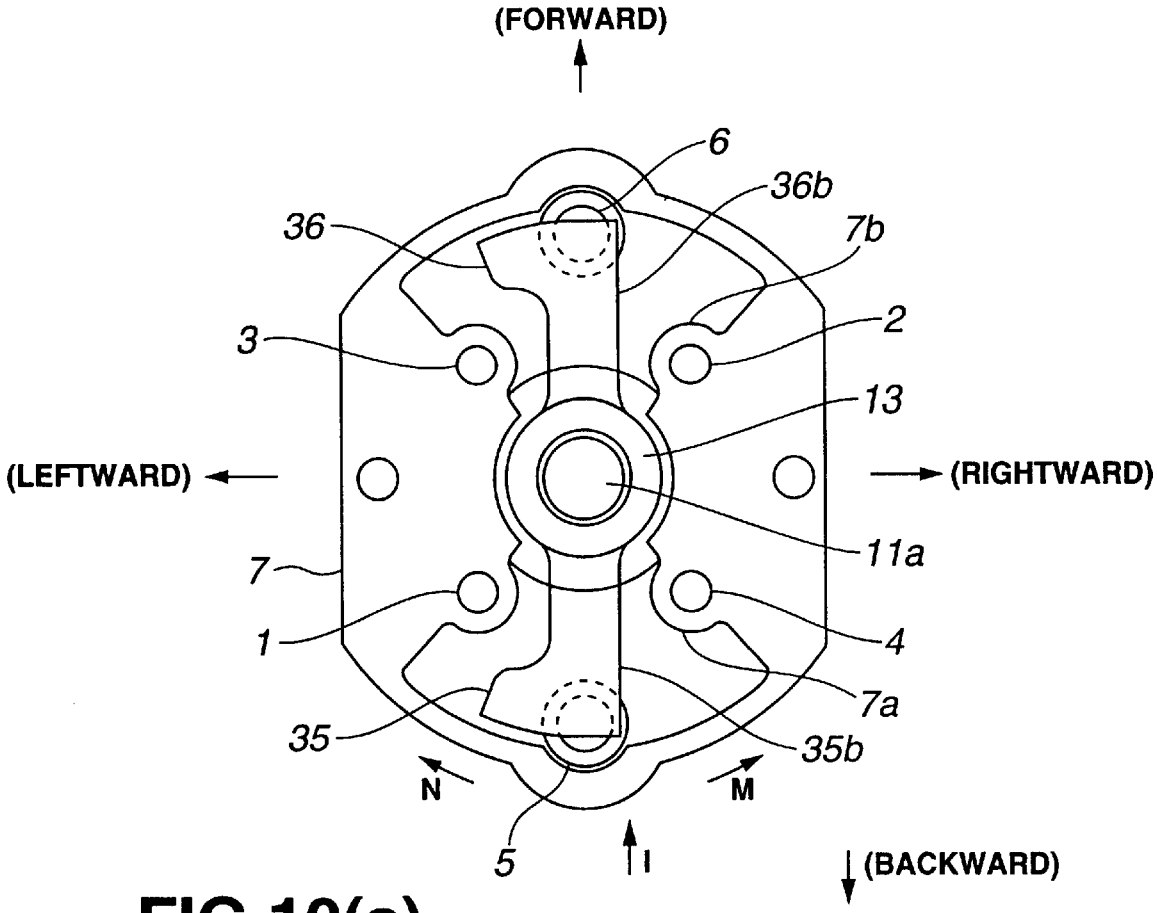
FIG. 10(*a*) is a sectional diagram taken along line H—H of FIG. 9, and FIG. 10(*b*) is a diagram viewed in a direction of arrow I of FIG. 10(*a*)
Figure 10B:
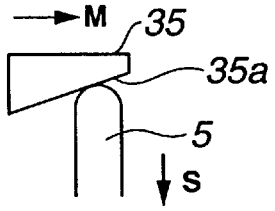

FIG. 10(*a*) is a sectional diagram taken along line H—H of FIG. 9. FIG. 10(*b*) is a diagram viewed in a direction of arrow I in FIG. 10(*a*).

Specifically, taper face 35*a* is formed on the bottom surface of the arm 35. The top end of the piston 5 is in contact with the taper face 35*a*. It is not shown in the drawing but taper face 36*a* is also formed on the bottom surface of the arm 36. The top end of the piston 6 is in contact with the taper face 36*a*.

The taper face 35*a* is designed to have a slope which can push down the piston 5 when the operation lever 8 is twisted in left direction M. Similarly, the taper face 36*a* is designed to have a slope which can push down the piston 6 when the operation lever 8 is twisted in right direction N.

Stopper 35*b* is formed on the arm 35. Contact surface 7*a* with which the stopper 35*b* comes in contact is formed on the body 7. When the shaft 13 is twisted, the stopper 35*b* comes in contact with the contact surface 7*a* of the body 7 to restrict the movement of the shaft 13. Similarly, stopper 36*b* is formed on the arm 36. Contact surface 7*b* with which the stopper 36*b* comes in contact is formed on the body 7. When the shaft 13 is twisted, the stopper 36*b* comes in contact with the contact surface 7*b* of the body 7 to restrict the movement of the shaft 13.

As shown in FIG. 10(*a*), the third embodiment has the pistons 1, 2, 3, 4 disposed in the same arrangement as in the second embodiment.

Therefore, when the operation lever 8 is tilted in a left direction for example, the pistons 3, 1 are moved downward, and the pilot pressure oil having a pressure corresponding to the tilted amount of the lever is output from the discharge ports 23, 21. Thus, the pilot pressure is applied to the pilot port 31*a* of the control valve 31 to tilt the blade to the left.

Referring to FIG. 10, an operation by twisting the operation lever 8 in the left direction will be described.

When the operation lever 8 is operated from its neutral position in direction M (counterclockwise direction in the drawing), the shaft 13 is twisted in the direction M, and the arm 35 integrally formed with the shaft 13 is twisted in the direction M.

When the arm 35 is twisted in the direction M, the piston 5 is pushed downward S by the taper surface 35*a*.

When the piston 5 is moved downward S, the pilot pressure oil having a pressure corresponding to the moved amount is discharged from the discharge port 25. Therefore, the blade is left-angled by a moving amount corresponding to the twisted amount of the operation lever 8. The operation lever 8 can be twisted to a twist position so that the stopper 35*b* of the arm 35 comes in contact with the contact surface 7*a* of the body 7 or a twist position so that the stopper 36*b* of the arm 36 on the opposite side comes in contact with the contact surface 7*b* of the body 7.

When the operation lever 8 is twisted in the direction N, the arm 36 is also twisted in direction N. Thus, the piston 6 is pushed downward by the taper surface 36*a*, and the pilot pressure oil is output from the discharge port 26 to right-angle the blade.

In the third embodiment, the relations between the positions of the pistons 1, 2, 3, 4 and the tilting directions of the operation lever 8 may be the same as in the first embodiment.

Then, the operation lever device 10 of a fourth embodiment will be described.

Figure 11:
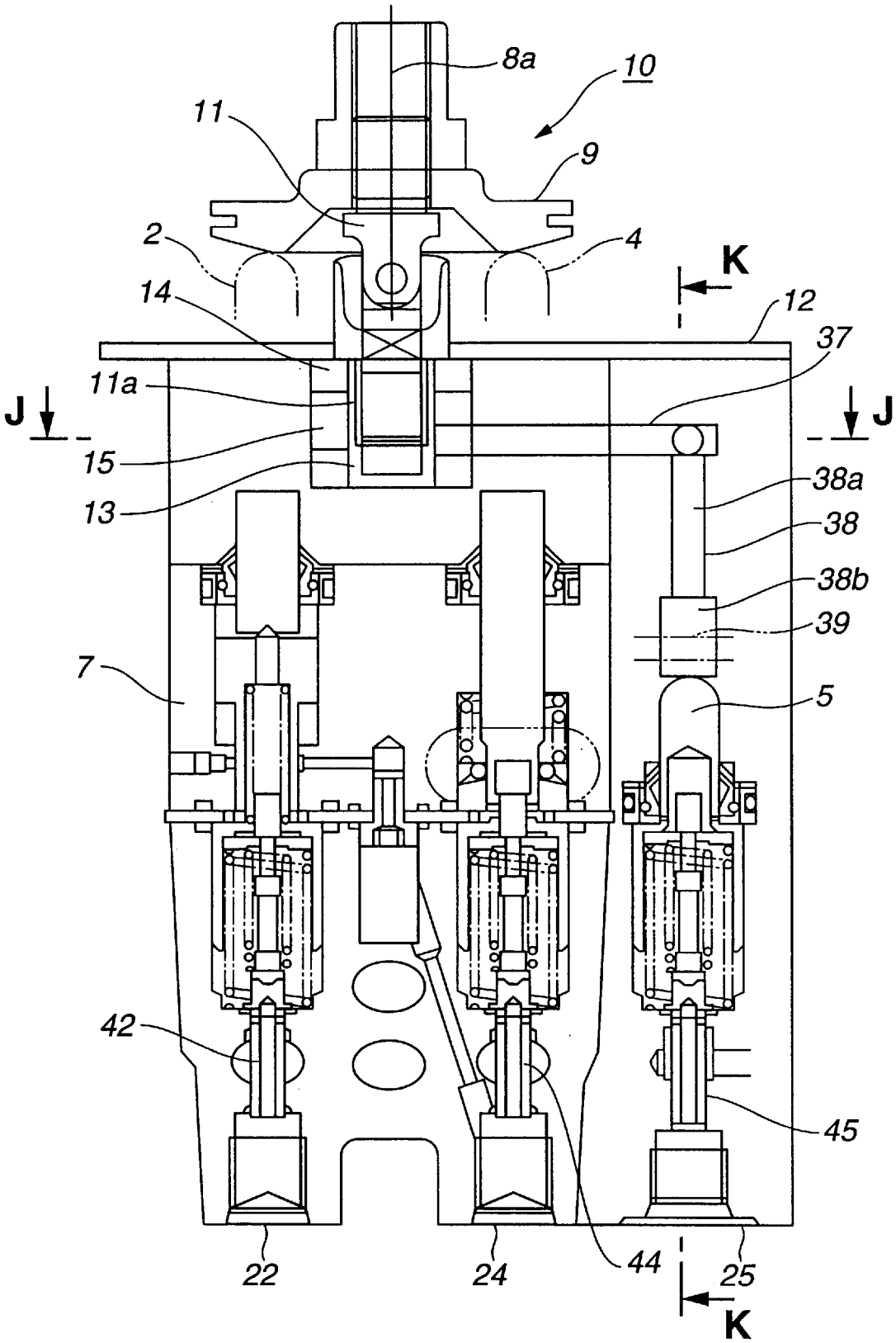
FIG. 11 is a vertical sectional diagram of the operation lever device of a fourth embodiment.

FIG. 11 is a vertical sectional diagram of the fourth embodiment. Like reference numerals are given to like components as those of FIG. 2 and their descriptions are omitted.

As shown in FIG. 11, arm 37 which is extended in a direction (the right direction in the drawing) perpendicular to the axial direction (the vertical direction in the drawing) of the shaft 13 is disposed on the shaft 13. The shaft 13 and the arm 37 are integrally formed.

The motion to twist the shaft 13 is converted into a motion to move the pistons 5, 6 downward through the arm 37 and the lever 38.

Figure 12:
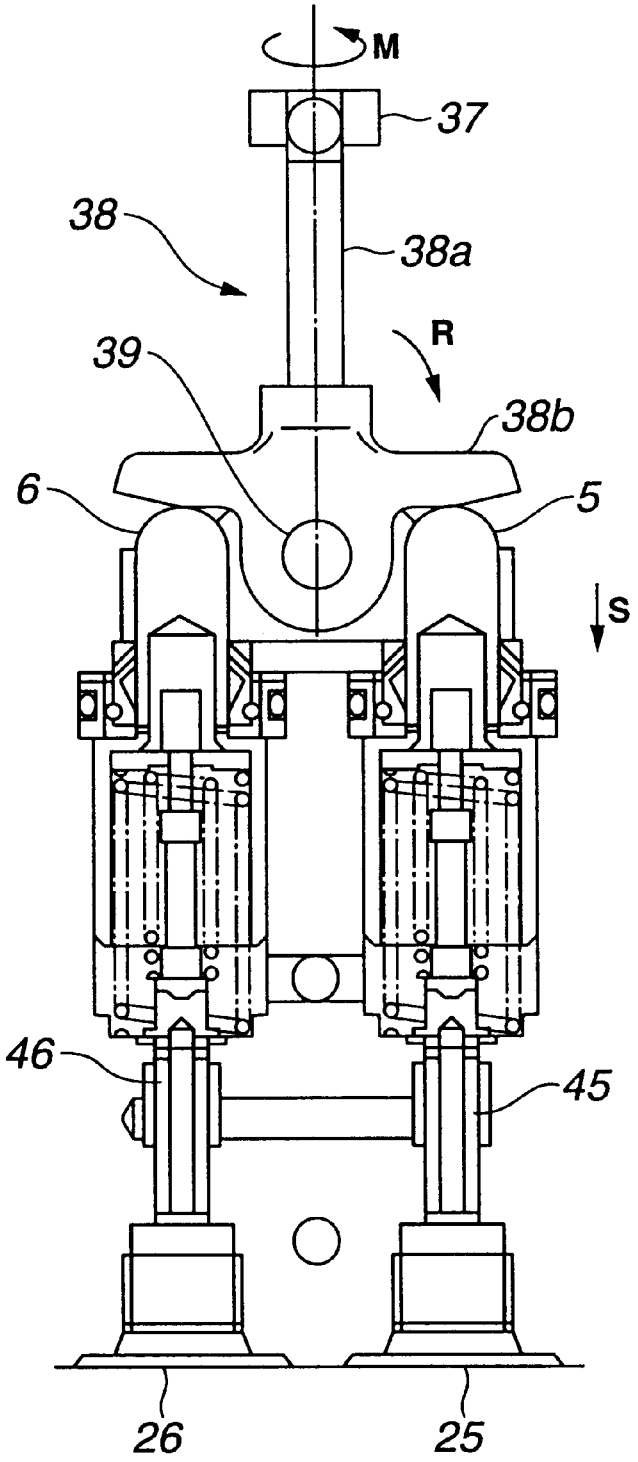
FIG. 12 is a sectional diagram taken along line K—K of FIG. 11.

FIG. 12 is a sectional diagram taken along line K—K of FIG. 11.

The lever 38 is comprised of rocker arm 38*b* whose bottom surface is in contact with the top ends of the pistons 5, 6 and arm 38*a* which is engaged with the arm 37. Within the body 7, pin 39 is vertically disposed relative to the arranged directions (vertical direction) of the pistons 5, 6. The rocker arm 38*b* of the lever 38 is fitted to the pin 39 so that it can rock about the pin 39. Therefore, when the shaft 13 is twisted, the twist force of the shaft 13 is transmitted from the arm 37 to the arm 38*a* of the lever 38, and the rocker arm 38*b* is rocked about the pin 39.

Figure 13:
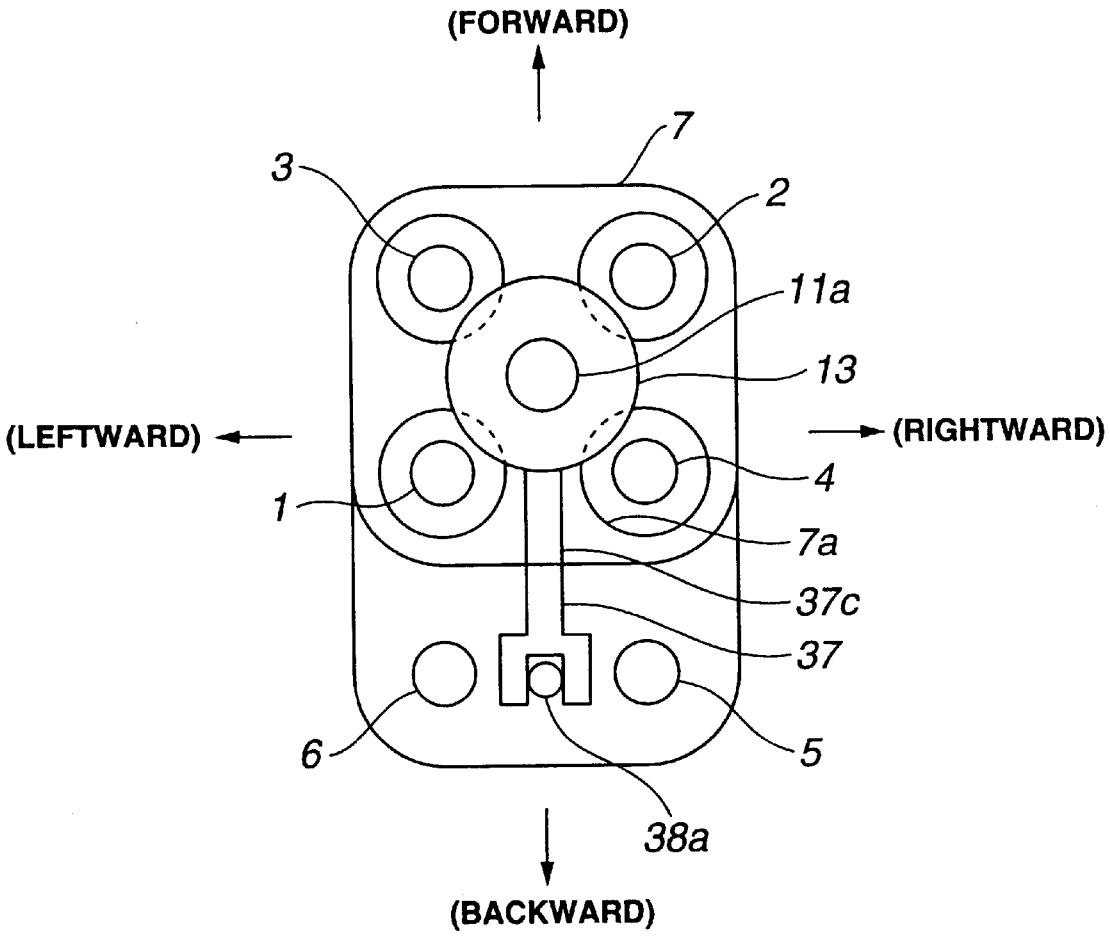
FIG. 13 is a sectional diagram taken along line J—J of FIG. 11.

FIG. 13 is a sectional diagram taken along line J—J of FIG. 11.

As shown in FIG. 13, stopper 37*c* is formed on the arm 37. Contact surface 7*a* with which the stopper 37*c* comes in contact is formed on the body 7. When the shaft 13 is twisted, the stopper 37*c* comes in contact with the contact surface 7*a* of the body 7 to restrict the movement of the shaft 13.

As shown in FIG. 13, the fourth embodiment has the pistons 1, 2, 3, 4 disposed in the same arrangement as in the second and third embodiments.

Therefore, when the operation lever 8 is tilted in a left direction for example, the pistons 3, 1 are moved downward, and the pilot pressure oil having a pressure corresponding to the tilted amount of the lever is output from the discharge ports 23, 21. Thus, the pilot pressure is applied to the pilot port 31*a* of the control valve 31 to tilt the blade to the left.

Then, the motion when the operation lever 8 is twisted in the left direction will be described with reference to FIG. 12.

As shown in FIG. 12, when the operation lever 8 is twisted from its neutral position in direction M, the shaft 13 is twisted in the direction M, and the twist force of the shaft 13 is transmitted from the arm 37 of the shaft 13 to the arm 38*a* of the lever 38, and the rocker arm 38*b* of the lever 38 is rocked about the pin 39 in right direction R in the drawing.

When the rocker arm 38*b* is rocked in the right direction R, the piston 5 is moved downward S. When the piston 5 is moved downward S, the pilot pressure oil having a pressure corresponding to the moved amount is output from the discharge port 25. Therefore, the blade is left-angled by the moved amount corresponding to the twisted amount of the operation lever 8. The operation lever 8 can be twisted to the twist position to have the stopper 37*c* of the arm 37 come in contact with the contact surface 7*a* of the body 7 (see FIG. 13).

Similarly, when the operation lever 8 is twisted in the right direction, the rocker arm 38*b* of the lever 38 is rocked in the left direction of the drawing. Thus, the piston 6 is moved downward, and the pilot pressure oil is output from the discharge port 26 to right-angle the blade.

In the fourth embodiment, the positions of the pistons 1, 2, 3, 4 and the tilting directions of the operation lever 8 may have the same relation as in the first embodiment.

Then, the operation lever device 10 of a fifth embodiment in which the pistons 5, 6 are disposed vertically relative to the pistons 1 to 4.

Figure 14:
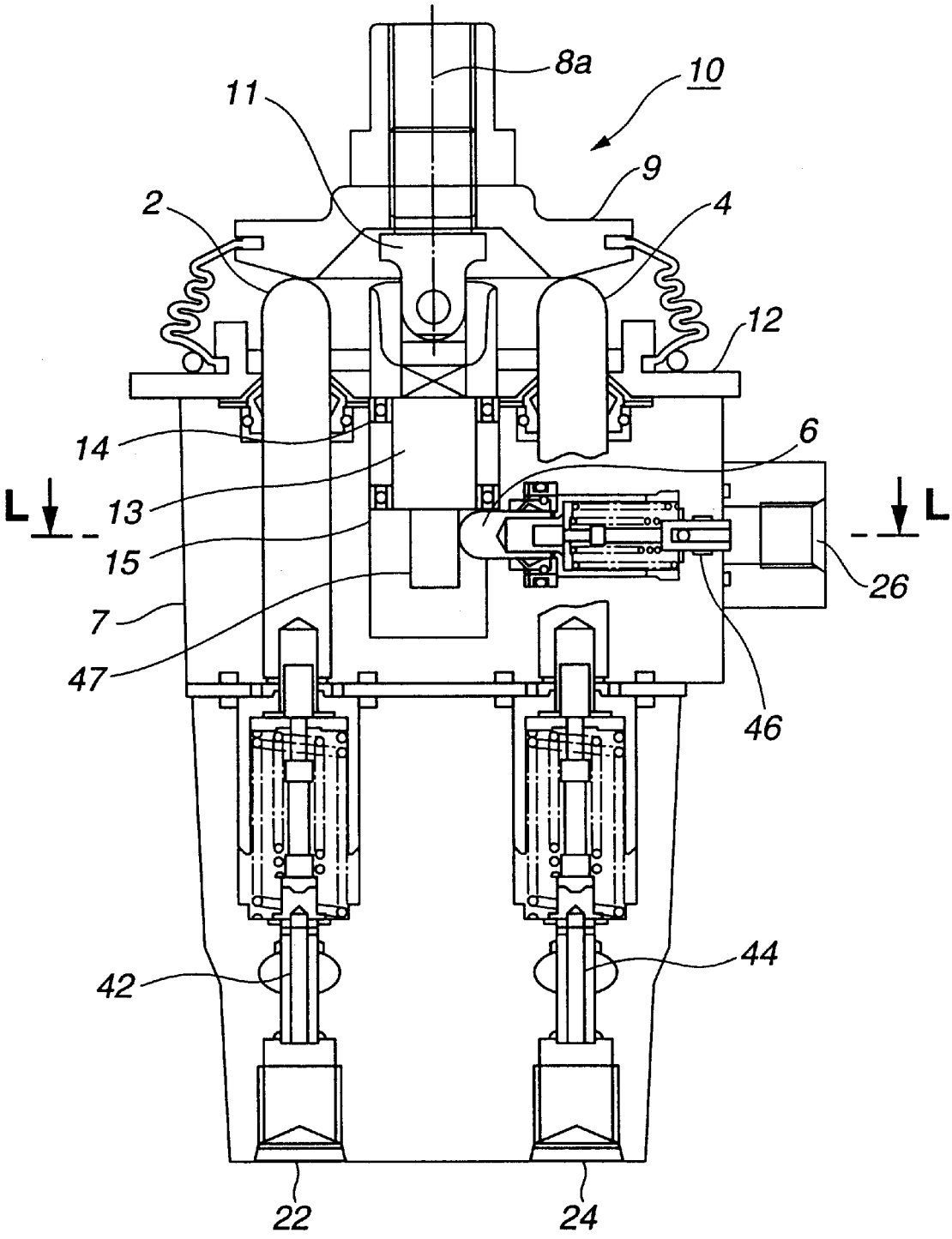
FIG. 14 is a vertical sectional diagram of the operation lever device of a fifth embodiment.

FIG. 14 is a vertical sectional diagram of the fifth embodiment. Like reference numerals are given to like components as those shown in FIG. 2 and their descriptions are omitted.

Rocker arm 47 which rocks coaxially with the shaft 13 is fitted to the bottom end of the shaft 13. The shaft 13 and the rocker arm 47 are integrally formed.

The motion to twist the shaft 13 is converted into motion to move the pistons 5, 6 through the rocker arm 47.

Figure 15A:
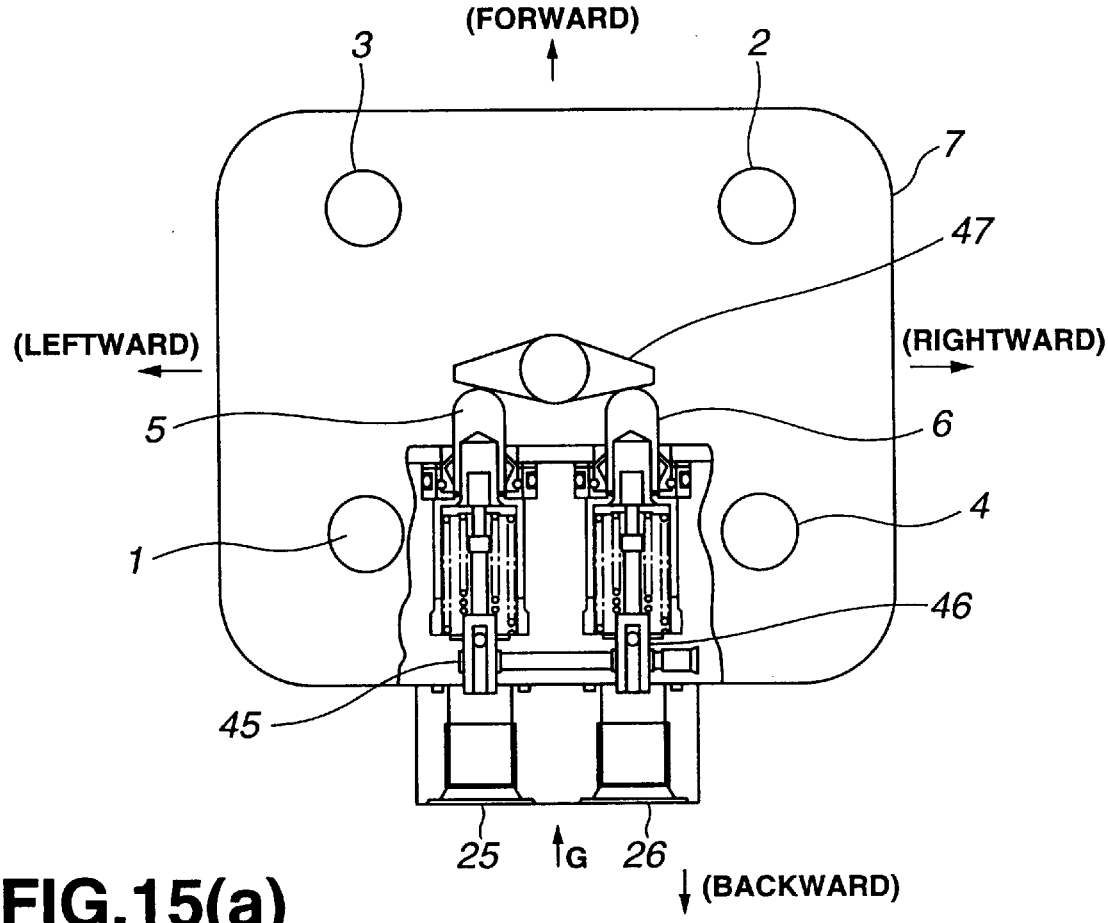
FIGS. 15(*a*) and 15(*b*) are sectional diagrams taken along line L—L of FIG. 14.
Figure 15B:
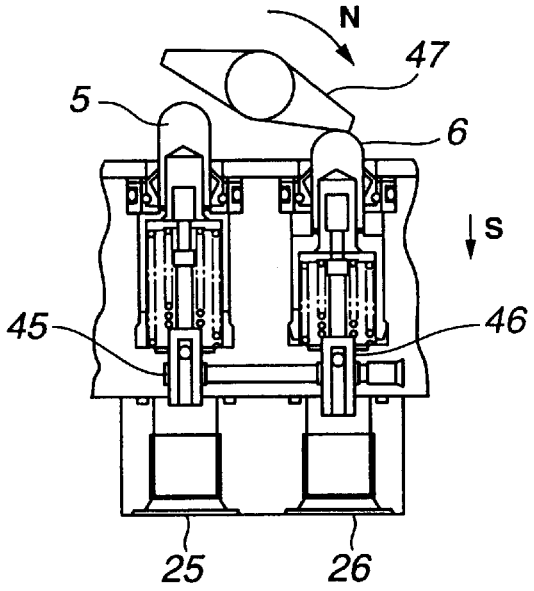

FIG. 15(*a*) is a sectional diagram taken along line L—L of FIG. 14. FIG. 15(*b*) is a sectional diagram taken along line L—L of FIG. 14 with the body 7 omitted. FIG. 15(*a*) shows a state that the operation lever 8 is held in its neutral position, and FIG. 15(*b*) shows a state that the operation lever 8 is twisted in right direction N.

Specifically, the rocker arm 47 is in contact with the leading ends of the pistons 5, 6. The rocker arm 47 rocks coaxially with the shaft 13. The pistons 5, 6 are disposed vertically relative to the arranged direction of the rocking shaft of the rocker arm 47, namely the arranged direction (vertical direction) of the shaft 13. The discharge ports 25, 26 corresponding to the pistons 5, 6 are formed on the side wall of the body 7.

As shown in FIG. 15(*a*), the fifth embodiment has the pistons 1, 2, 3, 4 arranged in the same relation as in the second, third and fourth embodiments.

Then, the motion as the operation lever 8 is twisted in the right direction will be described with reference to FIG. 15.

As shown in FIG. 15(*b*), when the operation lever 8 is twisted from its neutral position in the direction N, the shaft 13 is twisted in the direction N, and the rocker arm 47 is also rocked in the same direction N as the shaft 13.

When the rocker arm 47 is rocked in the direction N, the piston 6 is moved in direction S. When the piston 6 is moved in the direction S, the pilot pressure oil having a pressure corresponding to the moved amount is discharged from the discharge port 26. Therefore, the blade is right-angled at a moving speed corresponding to the twisted amount of the operation lever 8. The fifth embodiment can also has a stopper in the same way as in the first to fourth embodiments. The operation lever 8 can be twisted to a twist position so that the stopper comes in contact with the contact surface of the body 7.

Similarly, when the operation lever 8 is twisted in the left direction, the rocker arm 47 is rocked in the left direction. Thus, the piston 5 is moved, the pilot pressure oil is output from the discharge port 25 accordingly, and the blade is left-angled.

In the fifth embodiment, the positions of the pistons 1, 2, 3, 4 and the tilting directions of the operation lever 8 may be mutually related in the same way as in the first embodiment.

Then, the operation lever device 10 of a sixth embodiment in which the pistons 5, 6 are disposed below the shaft 13 will be described.

Figure 16:
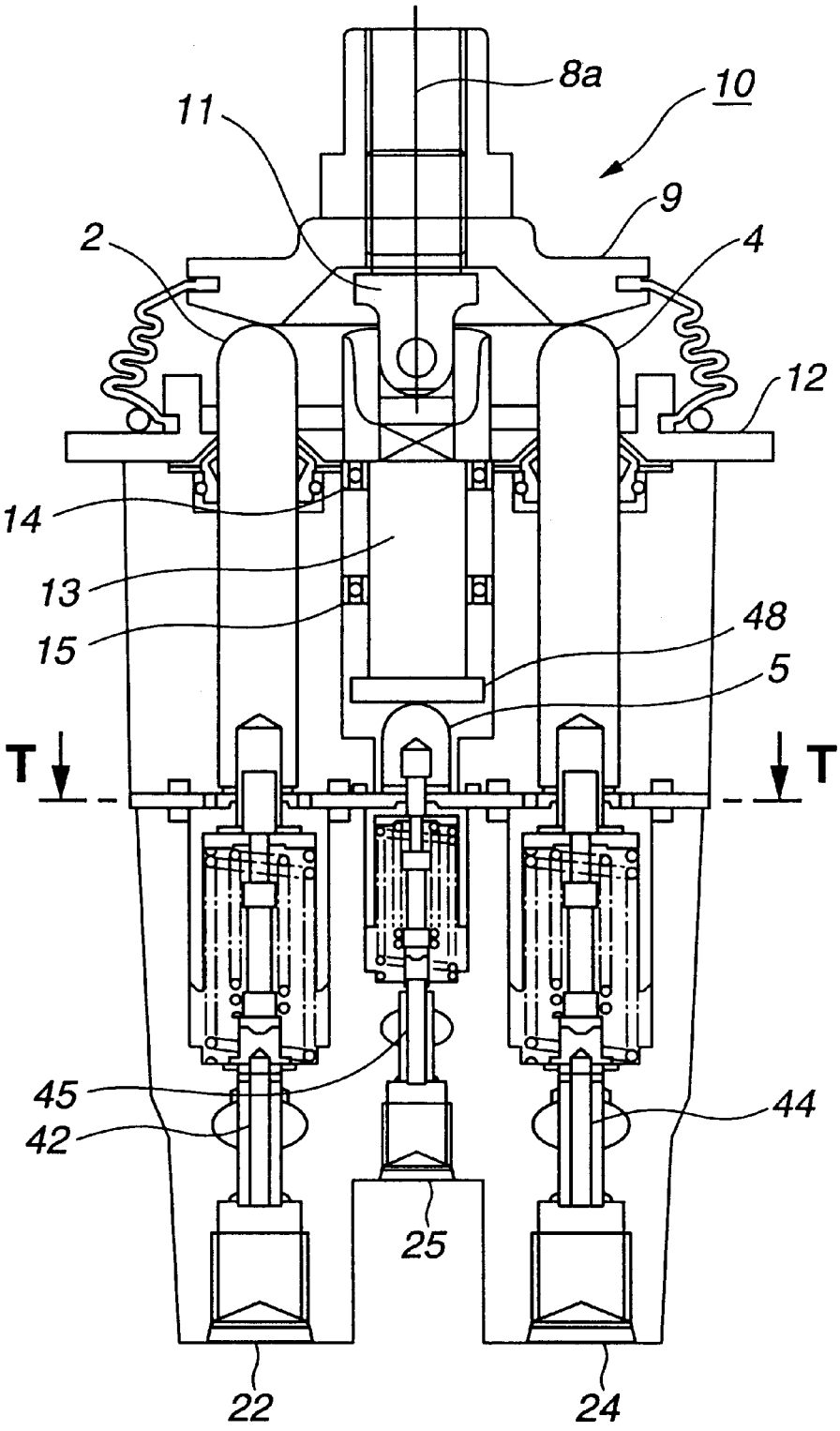
FIG. 16 is a vertical sectional diagram of the operation lever device of a sixth embodiment.

FIG. 16 is a vertical sectional diagram of the sixth embodiment. Like reference numerals are given to like components as those of FIG. 2 and their descriptions are omitted.

As shown in FIG. 16, cam 48 which twists coaxially with the shaft 13 is fitted to the bottom end of the shaft 13. The shaft 13 and the cam 48 are integrally formed.

The motion to twist the shaft 13 is converted into motion to move the pistons 5, 6 downward through the cam 48.

Figure 17:
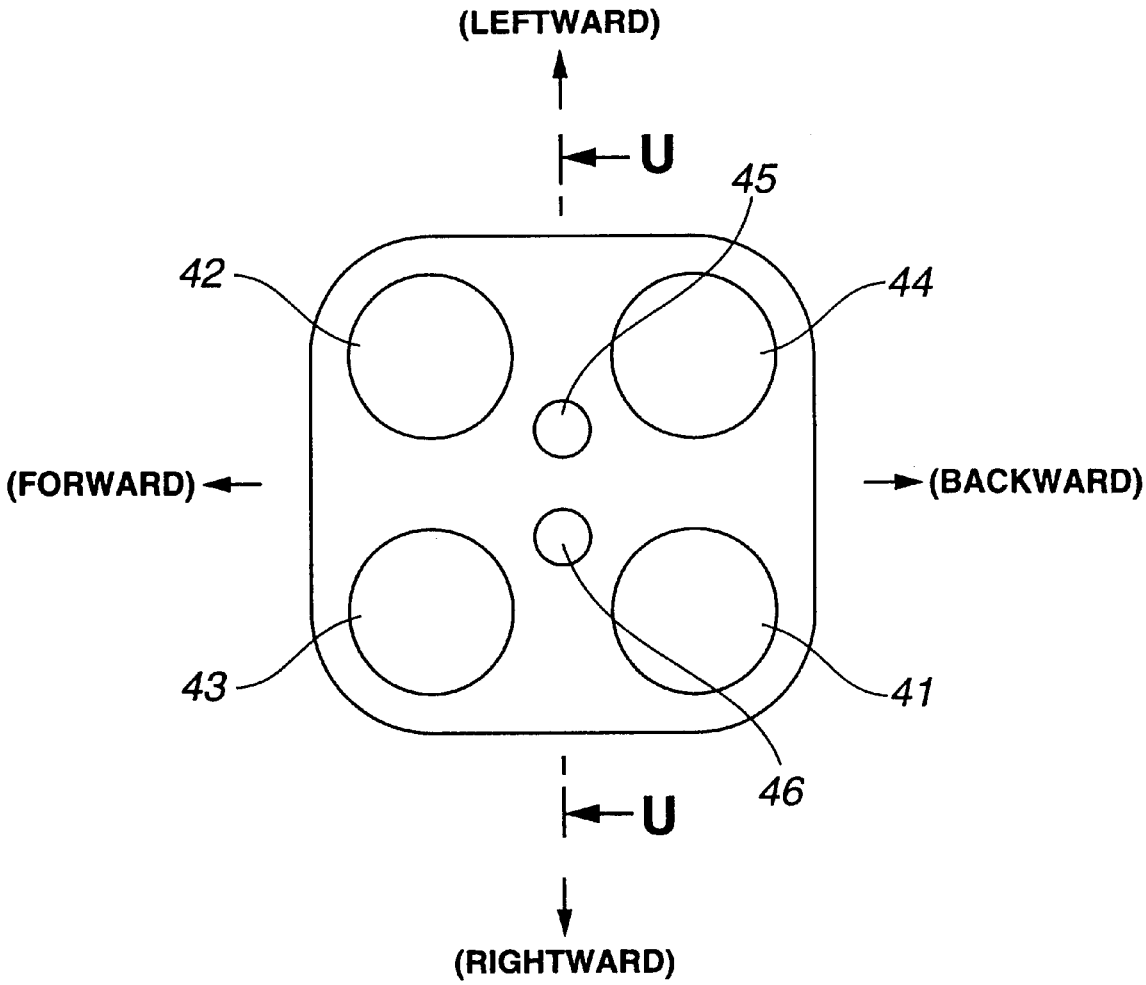
FIG. 17 is a sectional diagram taken along line T—T of FIG. 16.

FIG. 17 is a sectional diagram taken along line T—T of FIG. 16.

As shown in FIG. 17, the sixth embodiment has pressure reducing valves 41, 42, 43, 44 of the pistons 1, 2, 3, 4 disposed in the same arrangement as in the second, third, fourth and fifth embodiments.

In this embodiment, the pistons 5, 6 are disposed not on the side of the shaft 13 but below it. Specifically, the pressure reducing valves 45, 46 are disposed to be surrounded by the pressure reducing valves 41, 42, 43, 44. Thus, because the pistons 5, 6 are disposed not on the side of the shaft 13 but below it, the body 7 is not increased its size in the horizontal direction, and the operation lever device 10 can be made compact.

Figure 18B:
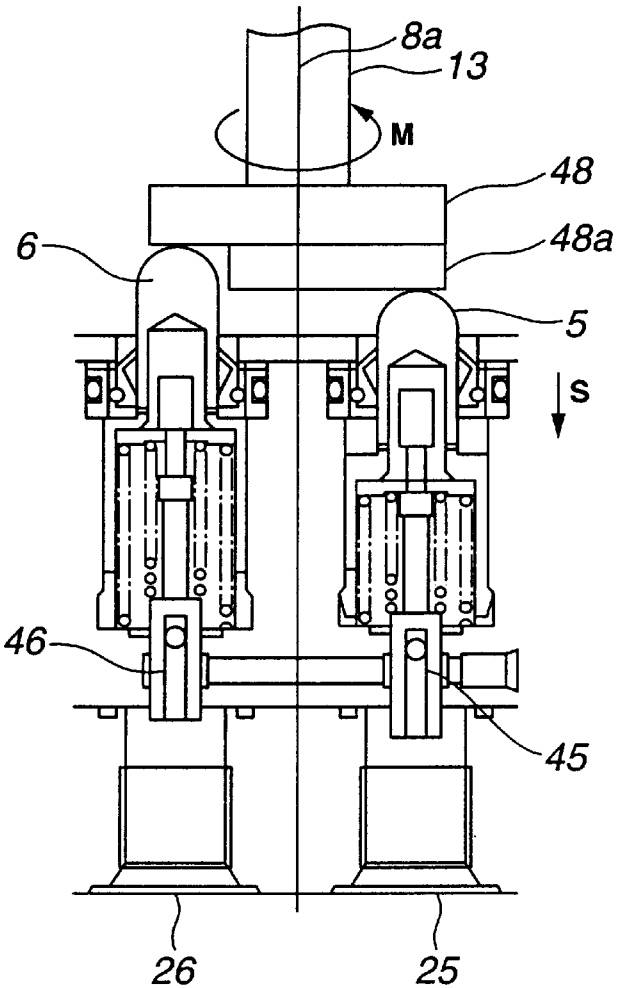
FIGS. 18(*a*) and 18(*b*) are sectional diagrams taken along line U—U of FIG. 17.
Figure 18A:
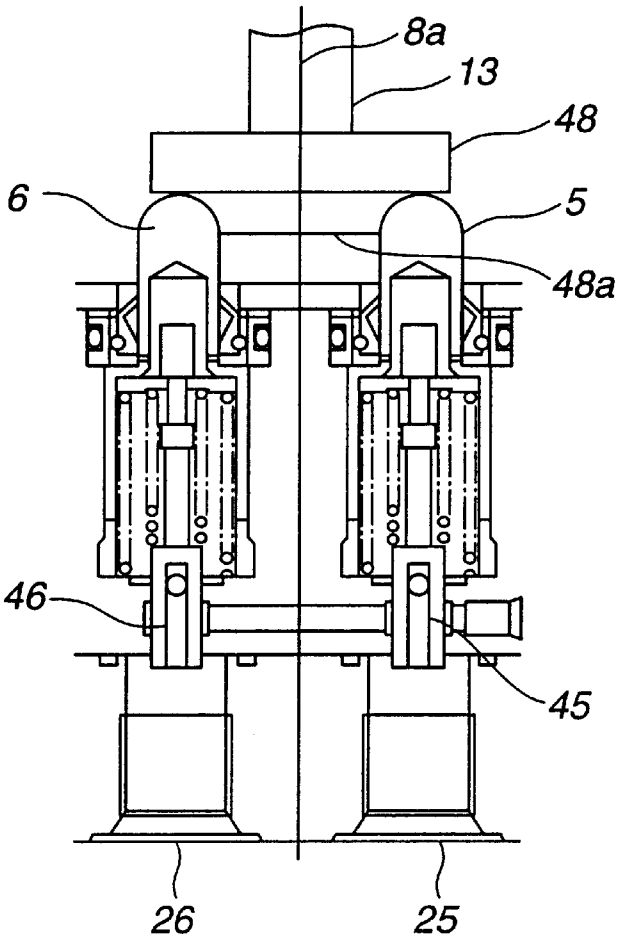

FIGS. 18(*a*) and 18(*b*) are sectional diagrams taken along line U—U of FIG. 17. FIG. 18(*a*) shows a state that the operation lever 8 is held in its neutral position, and FIG. 18(*b*) shows a state that the operation lever 8 is twisted in the left direction M.

As shown in FIG. 18, cam head 48*a* on the bottom surface of the cam 48 is in contact with the top ends of the pistons 5, 6. The cam head 48*a* is formed to have a cam shape to push down the piston 5 when the cam 48 is twisted in the direction M and to push down the piston 6 when the cam 48 is twisted in the right direction.

Then, the operation when the operation lever 8 is twisted in the left direction will be described with reference to FIG. 18.

As shown in FIG. 18(*b*), when the operation lever 8 is operated from its neutral position in the direction M shown in FIG. 18(*a*), the shaft 13 is twisted in the direction M, and the cam 48 is also twisted in the same direction M as the shaft 13.

When the cam 48 is twisted in the direction M, the piston 5 is moved downward S. According to the movement of the piston 5 in the downward direction S, the pilot pressure oil having a pressure corresponding to the moved amount is discharged from the discharge port 25. Therefore, the blade is left-angled by the moved amount corresponding to the twisted amount of the operation lever 8. In the sixth embodiment, a stopper may also be disposed in the same way as in the first to fifth embodiments. The operation lever 8 can be twisted to the movement position so that the stopper comes in contact with the contact surface of the body 7.

Similarly, when the operation lever 8 is twisted in the right direction, the cam 48 is twisted in the right direction. Thus, the piston 6 is moved downward, the pilot pressure oil is output from the discharge port 26 accordingly, and the blade is right-angled.

The sixth embodiment may have the positions of the pistons 1, 2, 3, 4 and the tilting directions of the operation lever 8 mutually related in the same way as in the first embodiment.

The bearings 14, 15 which twistably support the shaft 13 in the aforesaid respective embodiments may be any sliding member. For example, a slip bush or a ball bearing may be used.

It was found that when the aforesaid operation lever device 10 is provided with the detent mechanism, the following problem is caused.

For example, it is assumed that the operation lever device 10 of the first embodiment shown in FIG. 2 is provided with the detent mechanism. When the operation lever 8 of the operation lever device 10 is tilted, the bottom surface of the disk plate 9 comes into contact with the top end (stopper) 12*a* of the plate 12. And, when the detent mechanism is operating here, the operation lever 8 is fixed in the tilted position.

The operation lever 8 in the tilted position is twisted, and the hand is moved off the operation lever 8. Then, the operation lever 8 is automatically returned to its original neutral twisting position by means of a spring power of the predetermined springs of the pressure-reducing valves 45, 46 shown in FIG. 5(*b*).

But, the detent mechanism operates to push the bottom surface of the disk plate 9 against the top end 12*a* of the plate 12. Therefore, even when the hand is moved off the operation lever 8 after it is twisted, the operation lever 8 does not return to the original neutral twisting position owing to the frictional force between the bottom surface of the disk plate 9 and the top end 12*a* of the plate 12.

An embodiment of the operation lever device 10 which can remedy the aforesaid problem will be described with reference to FIG. 19, FIG. 20, FIG. 21 and FIG. 22.

The seventh embodiment shown in FIG. 19, FIG. 20, FIG. 21 and FIG. 22 has basically the same configuration as the first embodiment described with reference to FIG. 1 to FIG. 6, and like reference numerals are given to like components and their descriptions are omitted. And, only differences in the structure will be described below.

Figure 19:
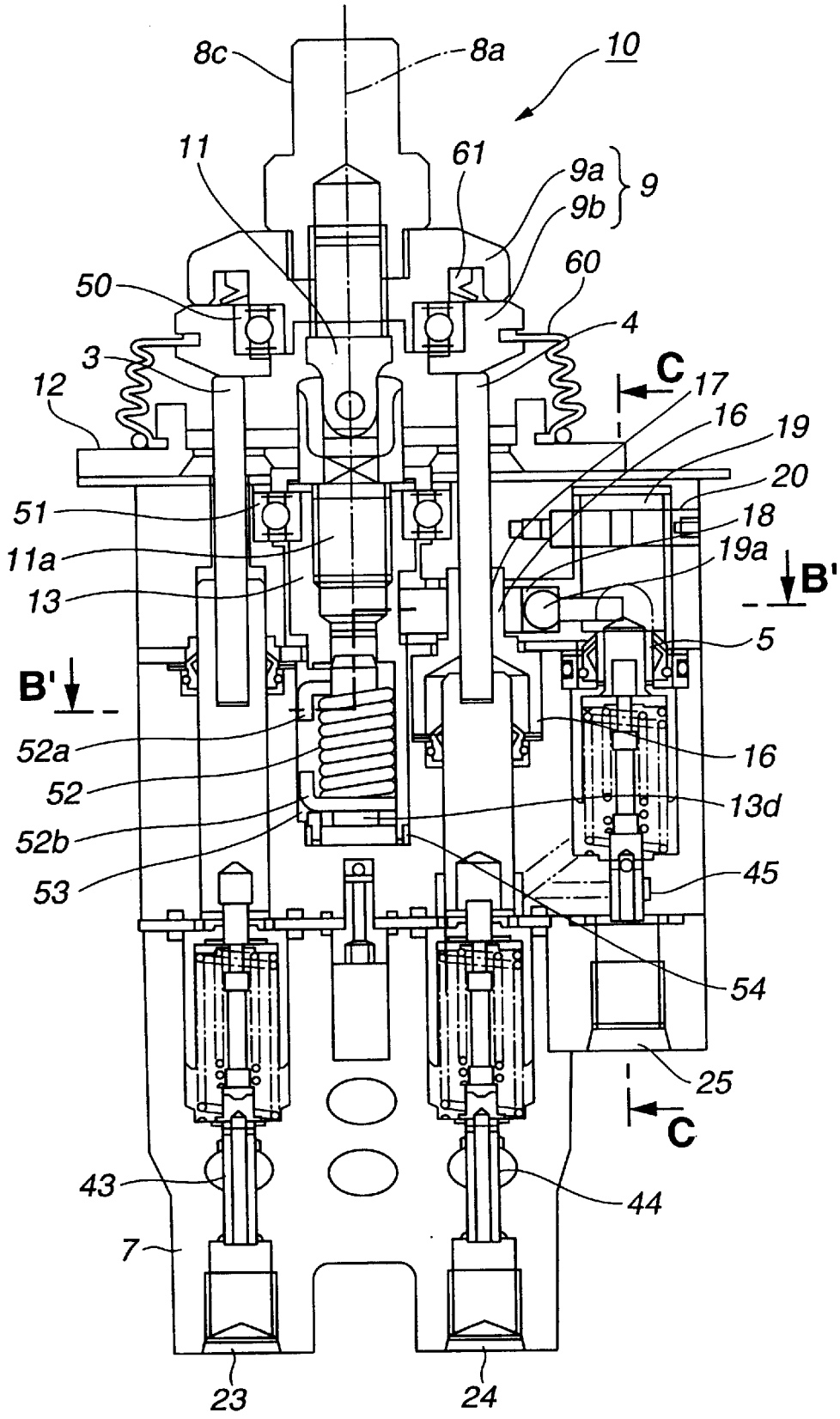
FIG. 19 is a vertical sectional diagram of the front end of the operation lever device of a seventh embodiment.
Figure 20:
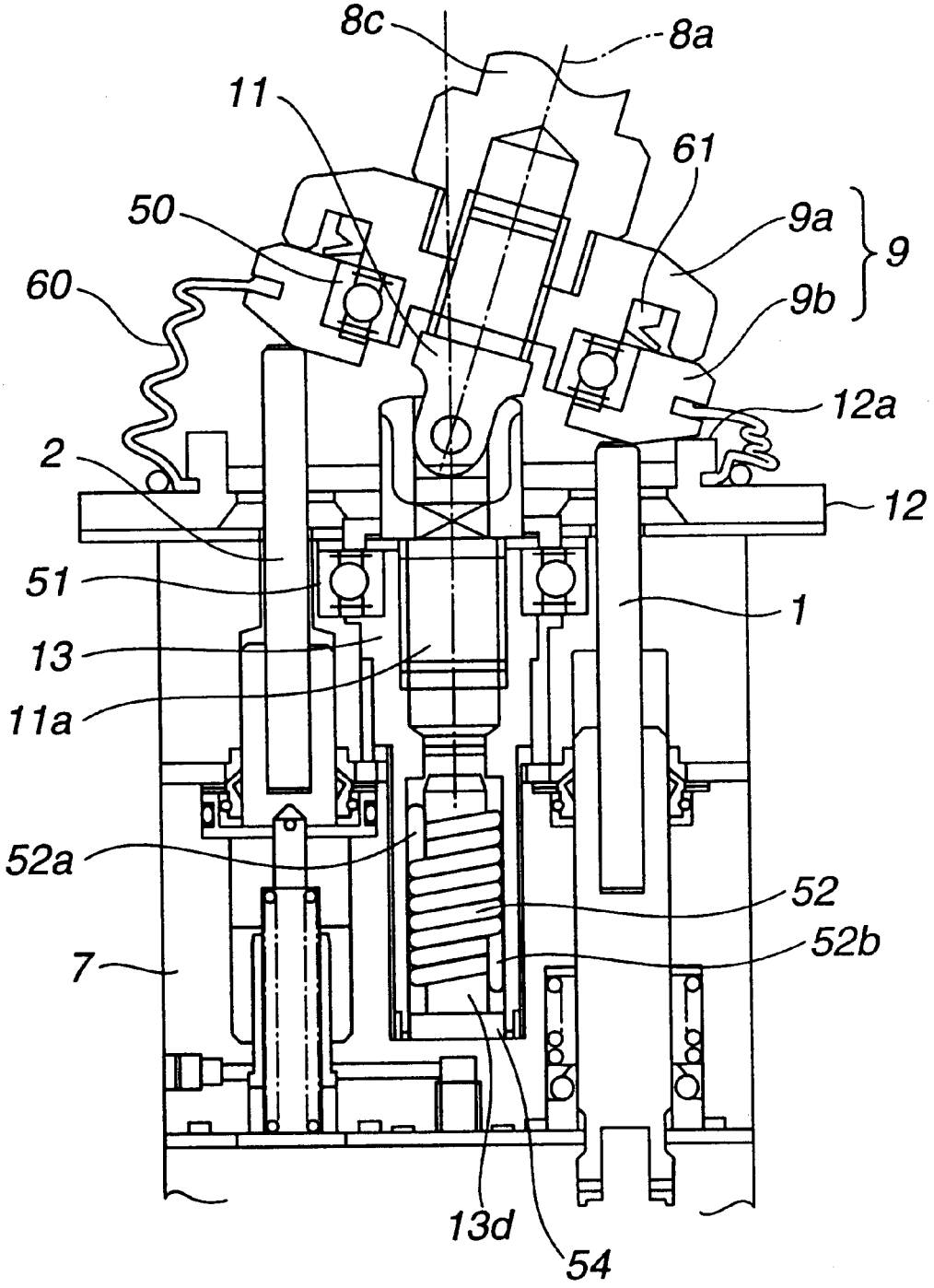
FIG. 20 is a vertical sectional diagram of a part of the operation lever device of the seventh embodiment.
Figure 21A:
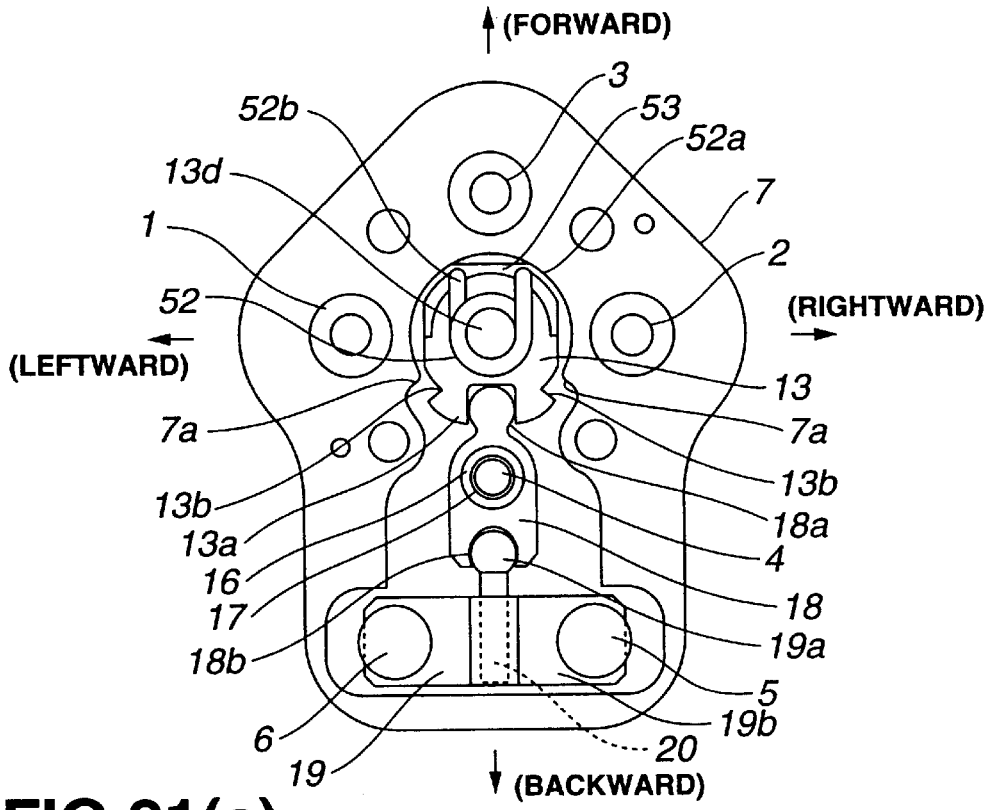
FIG. 21(*a*) is a sectional diagram viewed in a direction of arrow D of FIG. 21(*b*) and taken along line B'—B' of FIG. 19, and FIG. 21(*b*) is a sectional diagram taken along line C—C of FIG. 19.
Figure 21B:
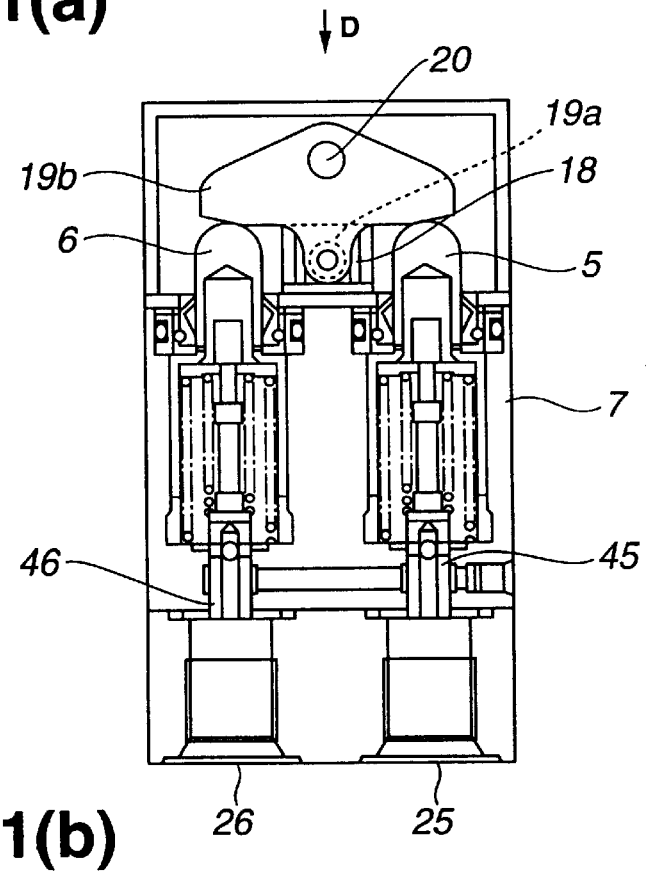
Figure 22A:
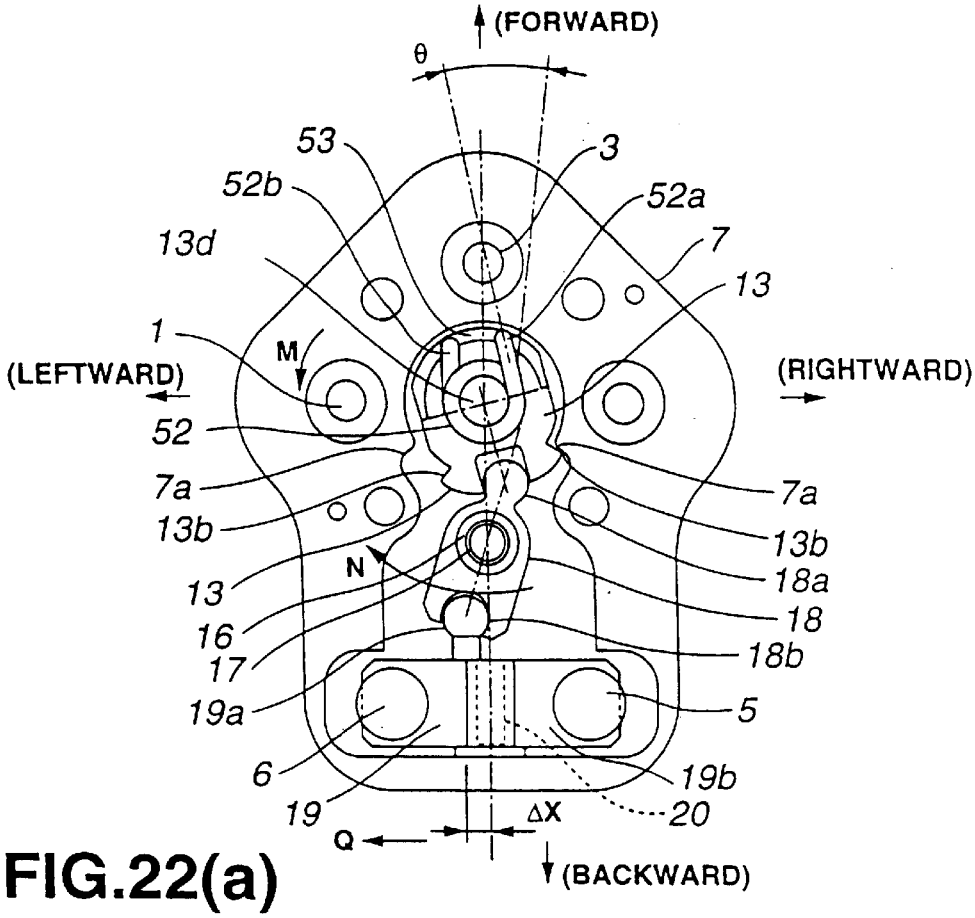
FIG. 22(*a*) is a sectional diagram viewed in a direction of arrow D of FIG. 22(*b*) and taken along line B'—B' of FIG. 19, and FIG. 22(*b*) is a sectional diagram taken along line C—C of FIG. 19.
Figure 22B:
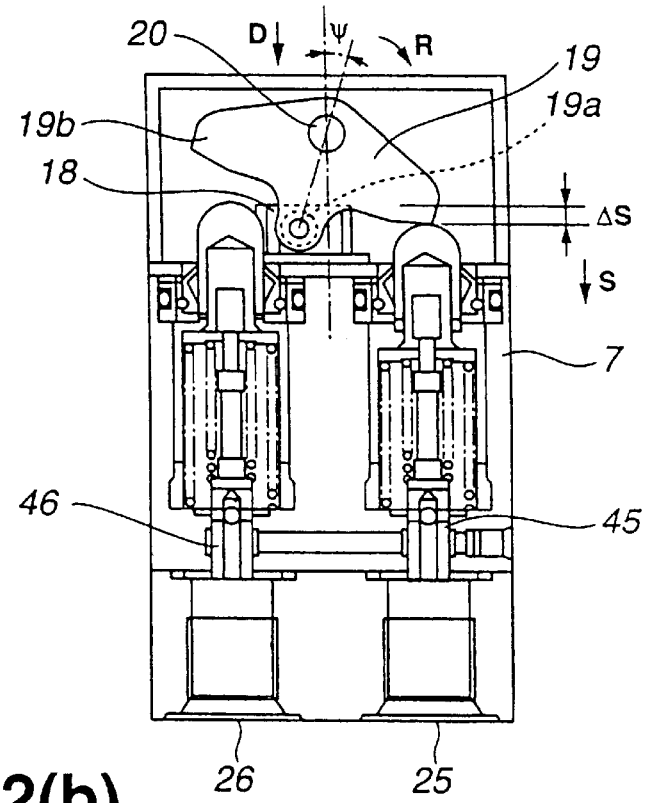

FIG. 19 is a diagram showing a vertical cross section of the whole of the operation lever device 10 corresponding to FIG. 2. FIG. 20 is a diagram showing a vertical cross section of a part of the operation lever device 10 corresponding to FIG. 3. FIGS. 21(*a*) and 21(*b*) are diagrams showing respective portions of the seventh embodiment corresponding to FIGS. 5(*a*) and 5(*b*). FIGS. 22(*a*) and 22(*b*) are diagrams showing respective portions of the seventh embodiment corresponding to FIGS. 6(*a*) and 6(*b*). FIG. 5(*a*) and FIG. 6(*a*) show cross sections taken along line B'—B' of FIG. 19.

As shown in FIG. 19, the disk plate 9 is separated into the upper disk plate 9*a* which has its center top connected with the shaft section 8*c* of the operation lever 8 and the lower disk plate 9*b* which has its lower center connected with the universal joint 11 and is tiltably supported by the universal joint 11. The upper disk plate 9*a* is twistably supported by the lower disk plate 9*b* so that it is twisted about the lever axis 8*a* through the ball bearing 53. Therefore, the upper disk plate 9*a* can be twisted about the lever axis 8*a* independent from the lower disk plate 9*b*.

Dust seal 61 is positioned between the upper disk plate 9*a* and the lower disk plate 9*b*. The dust seal 61 prevents outside dust from entering the ball bearing 50.

The space between the lower disk plate 9*b* and the plate 12 is separated from the outside by dust cover 60. The dust cover 60 is formed of a flexible material.

The top end of the shaft 13 is twistably supported by the ball bearing 51.

A lower part of the shaft 13 forms a spring chamber. The bottom end of the shaft 13 is twistably supported by guide bush 54. The spring chamber of the shaft 13 accommodates torsion spring (torsion coil spring) 52 which is wound in the shape of a coil. The torsion spring 52 has a single torsion structure for example. It may also have a double torsion structure. At a lower part of the shaft 13, spring holder 13*a* having a diameter smaller than the upper part is formed. The spring holder 13*a* is inserted into the center of the torsion spring 52.

The body 7 is formed to have groove 53 for accommodating upper arm 52*a* and lower arm 52*b* of the torsion spring 52. The upper arm 52*a* and lower arm 52*b* of the torsion spring 52 are in contact with the inner wall of the groove 53.

Referring to FIG. 20 to FIG. 22, an operating state when the operation lever 8 is twisted after it is tilted from the neutral position in a direction to push down the piston 1 and held in the tilted state will be described below.

When the hand is moved off the operation lever 8 after it is tilted, the detent mechanism operates to keep a state that the bottom surface of the lower disk plate 9*b* is kept pressed against the top end 12*a* of the plate 12, and the operation lever 8 is held in the tilted position. This state is shown in FIG. 20. And, the operation lever 8 is in the neutral twisting position as shown in FIGS. 21(*a*) and 21(*b*).

When the operation lever 8 is twisted in direction M (a counterclockwise direction in the drawing) by predetermined angle θ from the neutral twisting position as shown in FIG. 22(*a*), the upper disk plate 9*a* is twisted about the lever axis 8*a* independently from the lower disk plate 9*b*. Therefore, the operation lever 8 can be twisted smoothly about the lever axis 8*a* without being affected by the frictional force between the lower disk plate 9*b* and the top end 12*a* of the plate 12.

When the operation lever 8 is twisted in the direction M about the lever axis 8*a*, the upper arm 52*a* of the torsion spring 52 is twisted together with the shaft 13 in the same direction. The operation lever 8 can be twisted to the predetermined twisting position so that the stopper 13*b* of the shaft 13 comes into contact with the contact surface 7*a* of the body 7. Meanwhile, the lower arm 52*b* of the torsion spring 52 keeps a position in contact with the inner wall of the groove 53. Therefore, according to the twisting of the shaft 13, the upper arm 52*a* of the torsion spring 52 is moved relative to the lower arm 52*b*. Thus, the torsion spring 52 produces a torsion spring force (torque) having a magnitude corresponding to the twisting position of the operation lever 8.

Accordingly, when the hand is moved off the operation lever 8 after it is twisted, the torsion spring force (torque) of the torsion spring 52 acts on the shaft 13 as a force for returning the operation lever 8 to the original neutral twisting position. When the operation lever 8 returns to the neutral twisting position, the upper disk plate 9*a* is also twisted about the lever axis 8*a* independent from the lower disk plate 9*b*. Therefore, the operation lever 8 returns to the original neutral twisting position quickly and smoothly coupled with the return force of the torsion spring 52 without being affected by the frictional force between the lower disk plate 9*b* and the top end 12*a* of the plate 12.

According to the embodiment described above, the operation lever 8 can be returned smoothly to the original neutral twisting position without being affected by the frictional force involved in the operation of the detent mechanism.

The seventh embodiment can be modified into various types.

In the seventh embodiment, the torsion spring force (torque) of the torsion spring 52 is utilized to return the operation lever 8 to the neutral twisting position. But, the torsion spring 52 may be omitted. In other words, it is configured that the disk plate 9 is separated to twist the upper disk plate 9*a* independent from the lower disk plate 9*b*, so that the operation lever 8 can be returned smoothly to the original neutral twisting position.

And, the configuration in that the disk plate 9 is separated to twist the upper disk plate 9*a* independent from the lower disk plate 9*b* can be omitted so to have a configuration having the torsion spring 52 only. Thus, the operation lever 8 can be returned smoothly to the original twisting position by means of the torsion spring force (torque) of the torsion spring 52.

In the seventh embodiment, the operation lever 8 is returned to the neutral twisting position by means of the elastic force of the torsion spring 52, but another elastic member can be used instead of the torsion spring 52. Specifically, a leaf spring may be used instead of the torsion coil spring, and another elastic member such as a torsion bar can be used.

The ball bearings 50, 51 are used in the seventh embodiment but they are not exclusive, and another sliding member such as a sliding bush may be used.

The seventh embodiment was described on the assumption that it is applied to the hydraulic operation lever device 10, but it may also be applied to an electrical operation lever device 10.

In the aforesaid respective embodiments, it was assumed to operate the blade of the bulldozer. But, the present invention can also be applied to the movement of a work machine or traveling equipment other than the blade of the bulldozer.

In the respective embodiments described above, the tilting and twisting operations of the single operation lever 8 were described to operate the operation objects (control valves 31 to 33) for three axes. But, it is to be noted that the present invention is not limited to the operation of the operation objects for three axes but can also be applied to the operation of an operation object for a single axis by the twist operation of the single operation lever 8. And, the invention can also be applied to the operations that among the operation objects for two axes, one axis is operated by the tilting operation of the operation lever 8 and the other axis is operated by the twist operation of the operation lever 8.

What is claimed is:

1. An operation lever device which moves pistons (1, 2, 3, 4) according to a tilted direction and a tilted amount of an operation lever (8), outputs an oil pressure signal according to the movement of the pistons (1, 2, 3, 4) and operates operation objects corresponding to first and second shafts (31, 32) according to the oil pressure signal, comprising:

pistons (5, 6) for a third shaft disposed in correspondence with an operation object corresponding to the third shaft (33);

twisting means (13, 14, 15) for twisting the operation lever (8) about a lever axis (8*a*); and conversion means (18, 19) for converting the movement to twist the operation lever about the lever axis (8*a*) into motion to move the third-shaft pistons (5, 6).

2. The operational lever device according to claim 1, wherein the twisting means twists the operation lever about the lever axis from a neutral twisting position to a predetermined twisting position, and wherein the operation lever device further comprises:

an elastic member for returning the operation lever to the neutral twisting position when the operation lever is twisted about the lever axis.

3. An operation lever device which is provided with a tilting fulcrum (11) for supporting the root of an operation lever (8) and tilting the operation lever (8), moves pistons (1, 2) according to the tilting operation of the operation lever (8), outputs an oil pressure signal according to the movement of the pistons (1, 2), and operates an operation object (31) according to the oil pressure signal, comprising:

twisting means (13, 14, 15) for twisting the operation lever (8) about the lever axis (8*a*), and conversion means (18, 19) for converting the movement to twist the operation lever (8) about the lever axis (8*a*) into movement to move pistons (5, 6), wherein:

the twisting means (13, 14, 15) and the conversion means (18, 19) are disposed on the other side of the operation lever (8) with the tilting fulcrum (11) therebetween.

4. The operational lever device according to claim 3, wherein the twisting means twists the operation lever about the lever axis from a neutral twisting position to a predetermined twisting position, and wherein the operation lever device further comprises:

an elastic member for returning the operation lever to the neutral twisting position when the operation lever is twisted about the lever axis.

5. An operation lever device which is provided with a disk plate to which the root of an operation lever is attached and a tilting fulcrum which tiltably supports the disk plate, moves pistons via the disk plate according to the tilting operation of the operation lever, and outputs a signal according to the movements of the pistons to operate an operation object according to the signal, wherein:

the disk plate is separated into a first disk plate to which the root of the operation lever is attached and a second disk plate which is tiltably supported by the tilting fulcrum;

twisting means are disposed to twist the first disk plate about the lever axis of the operation lever independent of the second disk plate; and a signal corresponding to the twisted position of the first disk plate about the lever axis is output to operate the operation object according to the signal.

6. The operation lever device according to claim 5, wherein the twisting means twists the operation lever about the lever axis from a neutral twisting position to a predetermined twisting position, and wherein the operation lever device further comprises:

an elastic member for returning the operation lever to the neutral twisting position when the operation lever is twisted about the lever axis.

7. An operation lever device which is provided with a disk plate to which the root of an operation lever is attached and a tilting fulcrum which tiltably supports the disk plate, moves pistons via the disk plate according to the tilting operation of the operation lever, and outputs a signal according to the movements of the pistons to operate an operation object according to the signal, wherein:

the disk plate is separated into a first disk plate to which the root of the operation lever is attached and a second disk plate which is tiltably supported by the twisting fulcrum;

twisting means are disposed to twist the first disk plate about the lever axis of the operation lever independent of the second disk plate from a neutral twisting position to a predetermined twisting position;

an elastic member is disposed to return the first disk plate to the neutral twisting position when the first disk plate is twisted about the lever axis, and a signal is output according to the twisting position of the first disk plate about the lever axis to operate the operation object according to the signal.

8. The operation lever device according to claim 5 or 7, wherein the first disk plate is twistably supported by the second disk plate through a bearing.

* * * * *